US007878224B2

(12) United States Patent
Quigley

(10) Patent No.: US 7,878,224 B2
(45) Date of Patent: Feb. 1, 2011

(54) FORMING FABRIC HAVING BINDING WARP YARNS

(75) Inventor: Scott Quigley, Bossier City, LA (US)

(73) Assignee: Voith Patent GmbH, Heidenheim (DE)

( * ) Notice: Subject to any disclaimer, the term of this patent is extended or adjusted under 35 U.S.C. 154(b) by 316 days.

(21) Appl. No.: 12/071,207

(22) Filed: Feb. 19, 2008

(65) Prior Publication Data

US 2009/0205739 A1 Aug. 20, 2009

(51) Int. Cl.
*D03D 3/04* (2006.01)
*D21F 7/08* (2006.01)
*D03D 25/00* (2006.01)

(52) U.S. Cl. ..... 139/383 A; 139/383 AA; 139/383 R; 162/358.2

(58) Field of Classification Search ..... 139/383 R, 139/383 A, 383 AA, 408, 411, 412, 413, 139/414; 162/348, 358.1, 358.2, 900, 902, 162/903, 904
See application file for complete search history.

(56) References Cited

U.S. PATENT DOCUMENTS 3,867,766 A 2/1975 Wagner
4,224,372 A 9/1980 Romanski
4,239,065 A 12/1980 Trokhan
4,314,589 A 2/1982 Buchanan et al.
4,423,755 A 1/1984 Thompson
4,501,303 A 2/1985 Osterberg
4,564,052 A 1/1986 Borel
4,832,090 A 5/1989 Krenkel et al.
5,101,866 A 4/1992 Quigley
5,151,316 A 9/1992 Dukin et al.
5,152,326 A 10/1992 Vohringer
5,324,248 A 6/1994 Quigley
5,343,896 A 9/1994 Schroder et al.
5,429,686 A 7/1995 Chiu et al.
5,437,315 A 8/1995 Ward
5,456,293 A 10/1995 Ostermayer et al.
5,520,225 A 5/1996 Quigley et al.
5,542,455 A 8/1996 Ostermayer et al.
5,555,917 A 9/1996 Quigley
5,694,980 A 12/1997 Quigley
5,713,397 A 2/1998 Quigley
5,731,059 A 3/1998 Smith et al.
5,817,213 A 10/1998 Ostermayer et al.
5,826,627 A 10/1998 Seabrook et al.
5,840,411 A 11/1998 Stlljes et al.
5,853,547 A 12/1998 Ahrens et al.
5,945,357 A 8/1999 Quigley
5,967,195 A 10/1999 Ward (Continued)

FOREIGN PATENT DOCUMENTS

EP 0 794 283 6/2005

(Continued)

OTHER PUBLICATIONS

U.S. Appl. No. 12/071,206, filed Feb. 19, 2008.

*Primary Examiner*—Bobby H Muromoto, Jr.
(74) *Attorney, Agent, or Firm*—Greenblum & Bernstein, P.L.C.

(57) ABSTRACT

Forming fabric that includes a top layer including top weft yarns and a bottom layer including bottom weft yarns. Binding warp yarns weave with the top weft yarns and bind to the bottom layer.

42 Claims, 10 Drawing Sheets

U.S. PATENT DOCUMENTS

| | | | | |
|---|---|---|---|---|
| 5,988,229 | A | 11/1999 | Quigley | |
| 6,148,869 | A | 11/2000 | Quigley | |
| 6,202,705 | B1 | 3/2001 | Johnson et al. | |
| 6,227,256 | B1 | 5/2001 | Quigley | |
| 6,237,644 | B1 | 5/2001 | Hay et al. | |
| 6,349,749 | B1 | 2/2002 | Quigley | |
| 6,530,398 | B1 | 3/2003 | Westerkamp | |
| 6,546,964 | B1 | 4/2003 | Westerkamp | |
| 6,581,645 | B1 | 6/2003 | Johnson et al. | |
| 6,592,714 | B2 | 7/2003 | Lamb | |
| 6,649,026 | B2 | 11/2003 | Lamb | |
| 6,834,684 | B2 | 12/2004 | Martin et al. | |
| 6,860,299 | B2 | 3/2005 | Kuji | |
| 6,926,043 | B2 | 8/2005 | Quigley et al. | |
| 6,953,065 | B2 | 10/2005 | Martin et al. | |
| 6,959,737 | B2 | 11/2005 | Ward | |
| 6,978,809 | B2 | 12/2005 | Quigley | |
| 7,007,722 | B2 | 3/2006 | Quigley et al. | |
| 7,048,012 | B2 | 5/2006 | Martin et al. | |
| 7,059,357 | B2 | 6/2006 | Ward | |
| 7,059,359 | B2 | 6/2006 | Quigley et al. | |
| 2002/0056536 | A1 | 5/2002 | Lamb | |
| 2004/0020621 | A1 | 2/2004 | Heger et al. | |
| 2004/0079434 | A1 | 4/2004 | Martin et al. | |
| 2004/0182465 | A1 | 9/2004 | Word | |
| 2004/0231745 | A1* | 11/2004 | Quigley et al. | 139/383 A |
| 2004/0238062 | A1 | 12/2004 | Quigley et al. | |
| 2005/0051230 | A1* | 3/2005 | Martin et al. | 139/383 R |
| 2005/0067040 | A1* | 3/2005 | Quigley | 139/383 A |
| 2005/0103397 | A1* | 5/2005 | Quigley et al. | 139/383 A |
| 2005/0139281 | A1* | 6/2005 | Martin et al. | 139/383 A |
| 2005/0167066 | A1 | 8/2005 | Herman et al. | |
| 2006/0009582 | A1 | 1/2006 | Zhang et al. | |
| 2006/0016505 | A1 | 1/2006 | Westerkamp | |
| 2006/0016509 | A1 | 1/2006 | Westerkamp et al. | |
| 2006/0048840 | A1* | 3/2006 | Quigley | 139/408 |
| 2006/0060321 | A1 | 3/2006 | Quigley et al. | |
| 2006/0063451 | A1 | 3/2006 | Serr et al. | |
| 2006/0085999 | A1 | 4/2006 | Scherb et al. | |
| 2006/0219312 | A1* | 10/2006 | Hay et al. | 139/383 A |
| 2006/0243338 | A1* | 11/2006 | Hawes et al. | 139/383 A |
| 2006/0278294 | A1* | 12/2006 | Quigley | 139/383 A |
| 2007/0006934 | A1* | 1/2007 | Quigley et al. | 139/383 R |
| 2007/0006935 | A1* | 1/2007 | Quigley et al. | 139/383 R |
| 2007/0028996 | A1* | 2/2007 | Quigley | 139/383 R |
| 2007/0068590 | A1* | 3/2007 | Quigley et al. | 139/383 A |
| 2007/0215304 | A1 | 9/2007 | Lippi Alves Fernandes et al. | |
| 2007/0240842 | A1 | 10/2007 | Scherb et al. | |
| 2007/0251659 | A1 | 11/2007 | Fernandes et al. | |
| 2007/0251660 | A1 | 11/2007 | Walkenhaus et al. | |
| 2007/0272385 | A1 | 11/2007 | Quigley et al. | |
| 2008/0105323 | A1* | 5/2008 | Hay et al. | 139/383 A |
| 2008/0149213 | A1* | 6/2008 | Quigley | 139/408 |
| 2008/0149214 | A1* | 6/2008 | Quigley | 139/410 |
| 2008/0196784 | A1* | 8/2008 | Quigley | 139/383 A |

FOREIGN PATENT DOCUMENTS

| | | |
|---|---|---|
| EP | 1 000 197 | 6/2006 |
| WO | 02/00996 | 1/2002 |
| WO | 2005/035867 | 4/2005 |
| WO | 2005/075732 | 8/2005 |
| WO | 2005/075737 | 8/2005 |
| WO | 2006/113818 | 10/2006 |

* cited by examiner

Fig. 5

| | | | | | | | | | | | |
|---|---|---|---|---|---|---|---|---|---|---|---|
| | | X | | | | | X | | | 45 | |
| X | ■ | | | | X | ■ | | | | 43 | 44 |
| | | | X | | | | | X | | 42 | |
| X | | ■ | | | X | | ■ | | | 40 | 41 |
| | | | X | | | | | X | | 39 | |
| | X | | | ■ | | X | | | ■ | 37 | 38 |
| | | | X | | | | | X | | 36 | |
| | X | ■ | | | | X | ■ | | | 34 | 35 |
| | | | | X | | | | | X | 33 | |
| | X | | ■ | | | X | | ■ | | 31 | 32 |
| | | | | X | | | | | X | 30 | |
| ■ | | X | | | ■ | | X | | | 28 | 29 |
| | | | | X | | | | | X | 27 | |
| | | X | ■ | | | | X | ■ | | 25 | 26 |
| X | | | | | X | | | | | 24 | |
| | | X | | ■ | | | X | | ■ | 22 | 23 |
| X | | | | | X | | | | | 21 | |
| | ■ | | X | | | ■ | | X | | 19 | 20 |
| X | | | | | X | | | | | 18 | |
| | | | X | ■ | | | | X | ■ | 16 | 17 |
| | X | | | | | X | | | | 15 | |
| ■ | | | X | | ■ | | | X | | 13 | 14 |
| | X | | | | | X | | | | 12 | |
| | | ■ | | X | | | ■ | | X | 10 | 11 |
| | X | | | | | X | | | | 9 | |
| ■ | | | | X | ■ | | | | X | 7 | 8 |
| | | X | | | | | X | | | 6 | |
| | ■ | | | X | | ■ | | | X | 4 | 5 |
| | | X | | | | | X | | | 3 | |
| X | | | ■ | | X | | | ■ | | 1 | 2 |
| 19 | 17 | 15 | 13 | 11 | 9 | 7 | 5 | 3 | 1 | | |
| 20 | 18 | 16 | 14 | 12 | 10 | 8 | 6 | 4 | 2 | | |

FORMING FABRIC HAVING BINDING WARP YARNS

BACKGROUND OF THE INVENTION

1. Field of the Invention

The present invention relates generally to papermaking, and relates more specifically to multilayer fabrics employed in papermaking. The invention also relates to the binding of multilayered forming fabric with warp yarns. The present invention also relates to. multilayer papermaker's fabrics that utilizes warp yarns to bind top and bottom layers such without disrupting the top fabric surface. The invention also provides for a fabric which utilizes a condensed sequence of warp knuckles in a weft float dominate structure in order to provide space in the weave for the binding warps to smoothly transition from the top layer to the bottom layer. The invention also provides for a fabric wherein the warp knuckles of several repeats of a weft float dominate pattern are condensed into a plain weave sequence that allows space for warps to float under the wefts for a distance.

2. Discussion of Background Information

In the conventional fourdrinier papermaking process, a water slurry, or suspension, of cellulosic fibers (known as the paper "stock") is fed onto the top of the upper run of an endless belt of woven wire and/or synthetic material that travels between two or more rolls. The belt, often referred to as a "forming fabric," provides a papermaking surface on the upper surface of its upper run which operates as a filter to separate the cellulosic fibers of the paper stock from the aqueous medium, thereby forming a wet paper web. The aqueous medium drains through mesh openings of the forming fabric, known as drainage holes, by gravity or vacuum located on the lower surface of the upper run (i.e., the "machine side") of the fabric.

After leaving the forming section, the paper web is transferred to a press section of the paper machine, where it is passed through the nips of one or more pairs of pressure rollers covered with another fabric, typically referred to as a "press felt." Pressure from the rollers removes additional moisture from the web; the moisture removal is often enhanced by the presence of a "balt" layer of the press felt. The paper is then transferred to a dryer section for further moisture removal. After drying, the paper is ready for secondary processing and packaging.

Typically, papermaker's fabrics are manufactured as endless belts by one of two basic weaving techniques. In the first of these techniques, fabrics are flat woven by a flat weaving process, with their ends being joined to form an endless belt by any one of a number of well-known joining methods, such as dismantling and reweaving the ends together (commonly known as splicing), or sewing on a pin-seamable flap or a special foldback on each end, then reweaving these into pin-seamable loops. A number of auto-joining machines are available, which for certain fabrics may be used to automate at least part of the joining process. In a flat woven papermaker's fabric, the warp yarns extend in the machine direction and the filling yarns or weft yarns extend in the cross machine direction.

In the second basic weaving technique, fabrics are woven directly in the form of a continuous belt with an endless weaving process. In the endless weaving process, the warp yarns extend in the cross machine direction and the filling yarns or weft yarns extend in the machine direction. Both weaving methods described hereinabove are well known in the art, and the term "endless belt" as used herein refers to belts made by either method.

Effective sheet and fiber support are important considerations in papermaking, especially for the forming section of the papermaking machine, where the wet web is initially formed. Additionally, the forming fabrics should exhibit good stability when they are run at high speeds on the papermaking machines, and preferably are highly permeable to reduce the amount of water retained in the web when it is transferred to the press section of the paper machine. In both tissue and fine paper applications (i.e., paper for use in quality printing, carbonizing, cigarettes, electrical condensers, and like) the papermaking surface comprises a very finely woven or fine wire mesh structure.

In prior art fabrics, there is typically not enough space within the weave pattern for top warps to bind to the bottom wefts without disrupting the top fabric surface. Such fabrics also do not typically provide space in the weave for the top warps to smoothly transition from the top layer to the bottom layer. Such fabrics also do not typically provide space for warps to float under the wefts for a distance.

SUMMARY OF THE INVENTION

The fabric of the present invention may be made using the prior art methods described above. The invention also provides for a multilayer fabric employed in papermaking. The invention further also provides for the binding of multilayered forming fabric using warp yarns such as warp yarns that weave in the top layer. The present invention also relates to multilayer papermaker's fabrics that utilizes warp yarns to bind top and bottom layers such without disrupting the top fabric surface.

The present invention also recognizes that it is better for a warp yarn weaving in the top layer to pass between a top and bottom weft yarn before weaving or binding with one or more bottom weft yarns than for the warp yarn to pass from over a top weft yarn to directly over a bottom weft yarn without first passing between top and bottom weft yarns.

By way of non-limiting example, the present invention provides for a forming fabric having a 5 shed/5 shed warp bound 3:2 weft ratio.

The invention also provides for a fabric which utilizes a condensed sequence of warp knuckles in a weft float dominate structure in order to provide space in the weave for the warps which weave in the top layer to smoothly transition from the top layer to the bottom layer. The invention also provides for a fabric wherein the warp knuckles of several repeats of a weft float dominate pattern are condensed into a plain weave sequence that allows space for warps to float under the wefts for a distance.

The present invention relates to a forming fabric comprising a top layer comprising top weft yarns, a bottom layer comprising bottom weft yarns, binding warp yarns weaving with the top weft yarns and binding to the bottom layer, and at least one of the binding warp yarns passing between at least one top and bottom weft yarns before passing over at least one bottom weft yarn.

The fabric may further comprise at least one of bottom warp yarns weaving with non-adjacent bottom weft yarns and bottom warp yarns weaving only in the bottom layer.

At least one of the at least one binding warp yarn may pass under at least two adjacent top weft yarns before passing over at least one bottom weft yarn and each binding warp yarn may bind to bottom layer by binding to non-adjacent bottom weft yarns. The binding warp yarns may weave with the top weft yarns and bind to different non-adjacent bottom weft yarns per pattern repeat. Each binding warp yarn may bind to at least three non-adjacent bottom weft yarns per pattern repeat.

After weaving with the top weft yarns, each binding warp yarn may bind to at least two non-adjacent bottom weft yarns per pattern repeat before again weaving with the top weft yarns. The binding warp yarns may bind to at least four non-adjacent bottom weft yarns per pattern repeat. After weaving with the top weft yarns, the at least one binding warp yarn may pass under at least two adjacent top weft yarns before binding with the bottom weft yarns. After weaving with the top weft yarns, the at least one binding warp yarn may pass under at least two adjacent top weft yarns before binding to two non-adjacent bottom weft yarns. After weaving with the top weft yarns, the at least one binding warp yarn may pass under at least three adjacent top weft yarns before binding with the bottom weft yarns. After weaving with the top weft yarns, the at least one binding warp yarn may pass under at least three adjacent top weft yarns before binding to-two non-adjacent bottom weft yarns.

The top layer and bottom layer may be bound together only by the binding warp yarns and the binding warp yarns are intrinsic warp yarns. Each binding warp yarn in a pattern repeat may weave with a plain weave with top weft yarns before binding with non-adjacent bottom weft yarns. Each binding warp yarn in a pattern repeat may weave with a plain weave with top weft yarns before binding with two non-adjacent bottom weft yarns.

In a pattern repeat, each binding warp yarn may weave with a plain weave with top weft yarns, then binds with two non-adjacent bottom weft yarns, and then weaves with a plain weave with top weft yarns. In a pattern repeat, the at least one binging warp yarn may bind with first and second non-adjacent bottom weft yarns and a bottom warp yarn weaves with the first and second bottom weft yarns. In a pattern repeat, the at least one binding warp yarn may bind with first, second and third non-adjacent bottom weft yarns and a bottom warp yarn weaves with the first, second and third bottom weft yarns. In a pattern repeat, the at least one binding warp yarn may bind with only first, second and third non-adjacent bottom weft yarns and a bottom warp yarn weaves with the first, second and third bottom weft yarns. In a pattern repeat, each binding warp yarn may bind with only first, second and third non-adjacent bottom weft yarns and corresponding bottom warp yarns weave only with a same first, second and third bottom weft yarns. In a pattern repeat, the at least one binding warp yarn may bind with first, second, third and fourth non-adjacent bottom weft yarns and a bottom warp yarn weaves with the first, second, third and fourth bottom weft yarns. In a pattern repeat, the at least one binding warp yarn may bind with only first, second, third and fourth non-adjacent bottom weft yarns and a bottom warp yarns weave with the first, second, third and fourth bottom weft yarns. In a pattern repeat, each binding warp yarn may bind with only first, second, third and fourth non-adjacent bottom weft yarns and corresponding bottom warp yarns weave only with the first, second, third and fourth bottom weft yarns. In a pattern repeat, all bottom warp yarns may weave only in the bottom layer to non-adjacent bottom weft yarns.

All of the binding warp yarns may weave only with a plain weave when in the top layer. All of the binding warp yarns may bind to non-adjacent bottom weft yarns in a pattern repeat. The binding warp yarns may bind to different non-adjacent bottom weft yarns in a pattern repeat. The top layer may have a papermaking surface and the bottom has a machine side surface.

In a pattern repeat, each of the binding warp yarns may be vertically stacked with respect to bottom warp yarns. In a pattern repeat, more top weft yarns may be utilized that bottom weft yarns. In a pattern repeat, 30 top weft yarns may be utilized and 20 bottom weft yarns are utilized. In a pattern repeat, 30 top weft yarns may be utilized and 15 bottom weft yarns are utilized. In a pattern repeat, 20 top or binding warp yarns are utilized and 20 bottom warp yarns may be utilized.

At least one of the binding warp yarns per pattern repeat may differ from bottom warp yarns in at least one of the following characteristics size, modulus, and material. At least one of the top weft yarns per pattern repeat may differ from the bottom weft yarns in at least one of the following characteristics size, modulus, and material. At least one of the binding warp yarns may be smaller in size than at least one bottom warp yarn. At least one of the top layer may have a different weave pattern than the bottom layer and the top layer may utilize a plain weave and the bottom layer does not utilize a plain weave.

The invention also provides for a forming fabric comprising a top layer comprising top weft yarns, a bottom layer comprising bottom weft yarns, at least one binding warp yarn weaving with the top weft yarns and binding to at least two non-adjacent bottom weft yarns, and at least one bottom warp yarn weaving only with bottom weft yarns.

The invention also provides for a forming fabric comprising a top layer comprising top weft yarns, a bottom layer comprising bottom weft yarns, at least one binding warp yarn weaving with top weft yarns and binding to at least two non-adjacent bottom weft yarns in a pattern repeat, and at least one bottom warp yarn weaving with the at least two non-adjacent bottom weft yarns.

The invention also provides for a method of making the fabric of any of the types described above, wherein the method comprises binding together the top and bottom layers using only the binding warp yarns.

The invention also provides for a method of making the fabric of any of the types described above, wherein the method comprises binding the top and bottom layers together using the binding warp yarns, wherein each binding warp yarn binds to at least three non-adjacent bottom weft yarns per pattern repeat.

Additional aspects of the present invention include methods of manufacturing warp-stitched triple layer fabrics and methods of using the triple layer papermaker's fabric described herein for making paper.

BRIEF DESCRIPTION OF THE FIGURES

The present invention is further described in the detailed description which follows, in reference to the noted plurality of drawings by way of non-limiting examples of exemplary embodiments of the present invention, in which like reference numerals, represent similar parts throughout the several views of the drawings, and wherein:

FIG. 5 shows a weave pattern repeat of a second embodiment of the present invention;

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
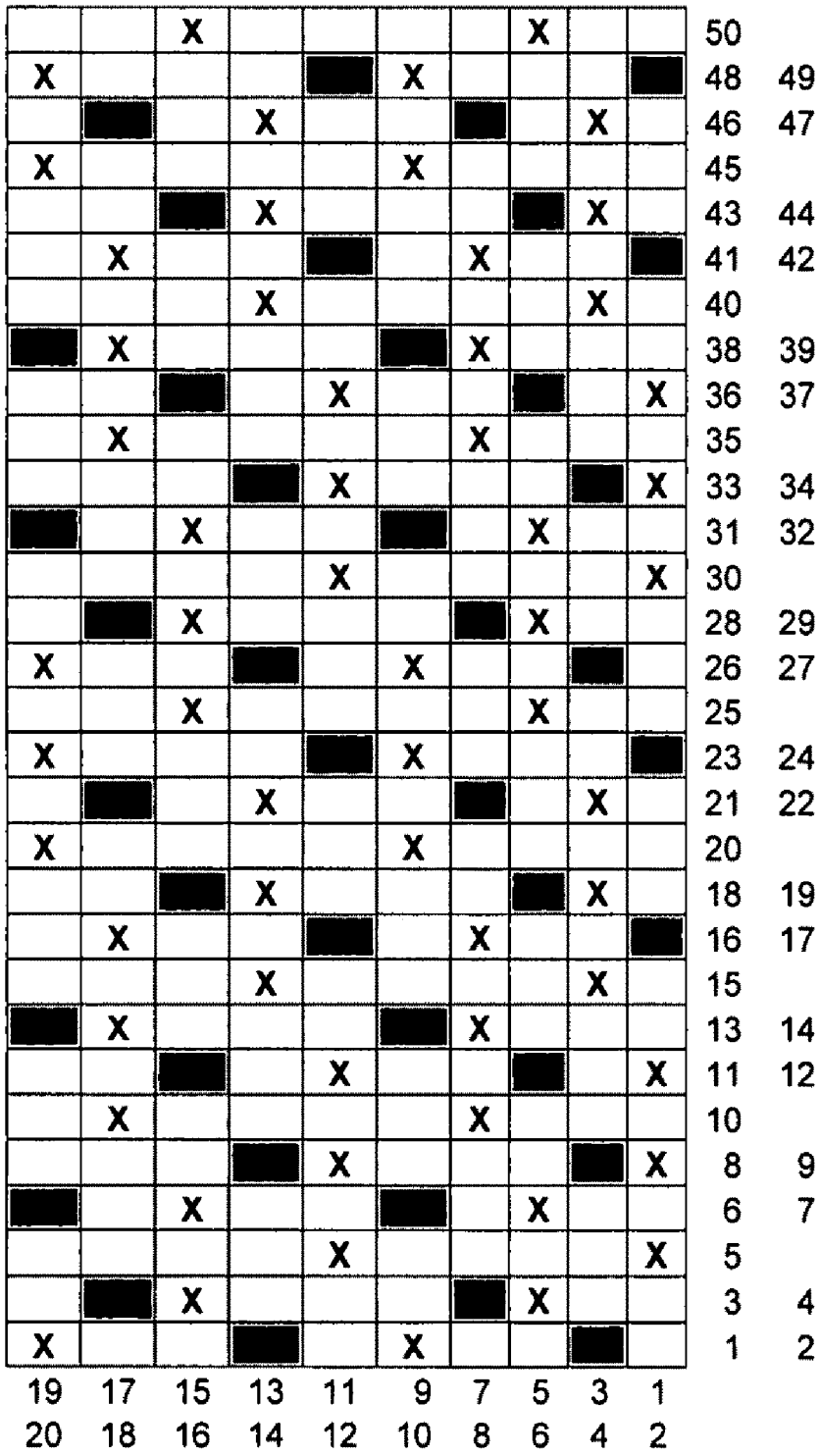
FIG. 1 shows a weave pattern repeat of a first embodiment of the present invention.

FIG. 1 shows a first non-limiting embodiment of the invention and depicts a top pattern view of the top fabric layer of the multilayer fabric (i.e., a view of the papermaking surface). The numbers 1-20 shown on the bottom of the pattern identify the upper and lower warp yarns while the right side numbers 1-50 show the upper or top and lower or bottom weft yarns. The bottom warp yarns shown on the bottom of the pattern are 1, 3, 5, 7, 9, 11, 13, 15, 17 and 19. The upper warp yarns shown on the bottom of the pattern are 2, 4, 6, 8, 10, 12, 14, 16, 18 and 20. The upper weft yarns shown on the right side of the pattern are 1, 3, 5, 6, 8, 10, 11, 13,:15, 16, 18, 20, 21, 23, 25, 26, 28, 30, 31, 33, 35, 36, 38, 40, 41, 43, 45, 46, 48 and 50. The lower weft yarns shown on the right side of the pattern are 2, 4, 7, 9, 12, 14, 17, 19, 22, 24, 27, 29, 32, 34, 37, 39, 42, 44, 47 and 49.

Also in FIG. 1, a blank cell is shown in locations where a binding warp yarn passes under a top weft yarn while a bottom warp yarn passes under a bottom weft yarn. Symbol X is shown in locations where a binding warp yarn passes over a top weft yarn while a bottom warp yarn passes under a bottom weft yarn. A shaded cell is shown in locations where a binding warp yarn passes over a bottom weft yarn while a bottom warp yarn passes over the same bottom weft yarn. As used herein, the term "over" in reference to a weave pattern of a warp yarn in the top layer means that the yarn passes vertically above a paper-side surface of the fabric and then over a top weft yarn. The term "over" in reference to a weave pattern of a warp yarn in the bottom layer means that the yarn passes vertically below a machine-side surface and then over a top weft yarn as opposed to passing between the top and bottom weft yarns.

Figure 2A:
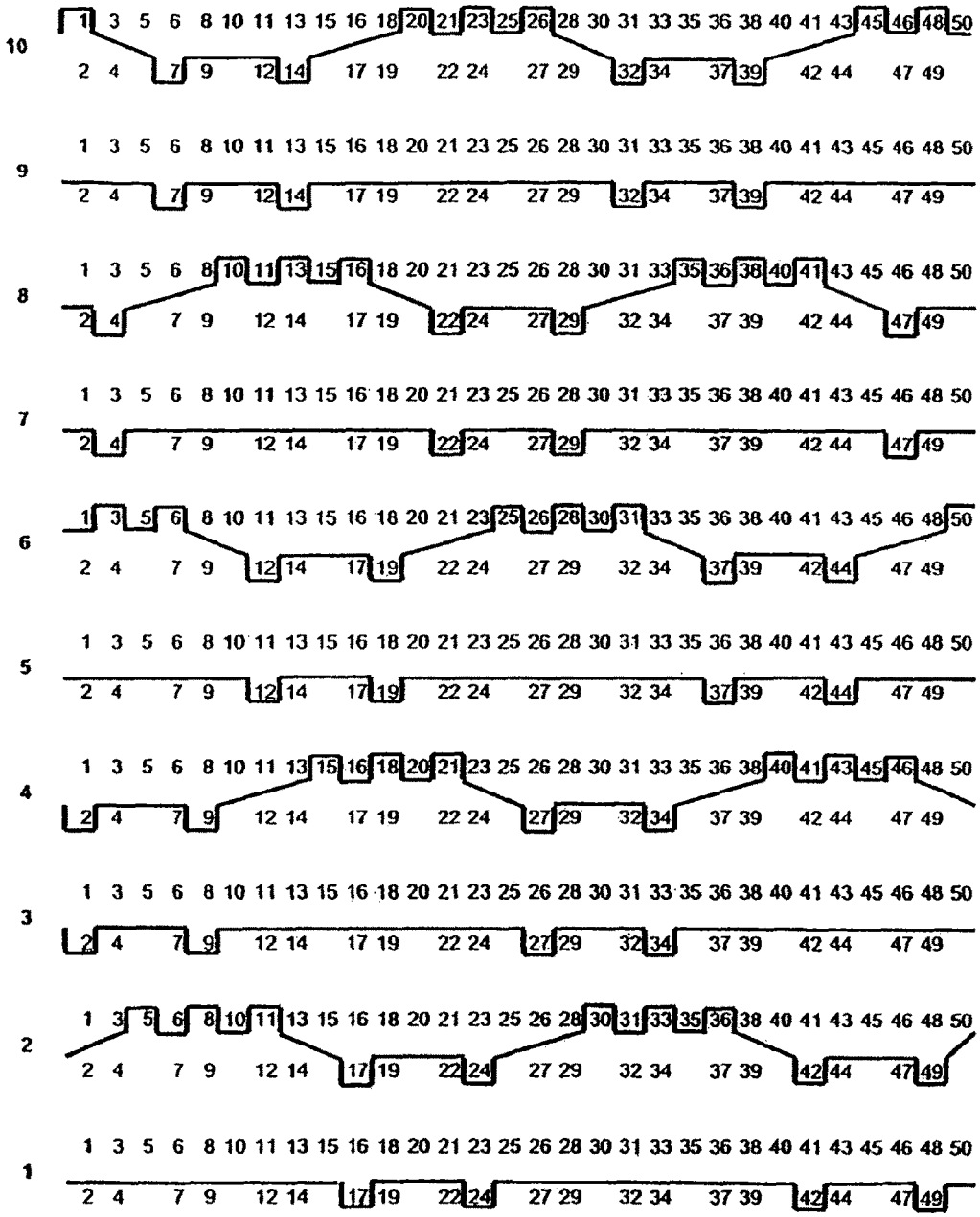
FIG. 2*a* shows a cross-section view of the repeat shown in FIG. 1 and illustrates binding yarns 2, 4, 6, 8 and 10 (listed from the bottom up on the left-hand side) and bottom warp yarns 1, 3, 5, 7 and 9 (listed from the bottom up on the left-hand side). The top and bottom weft yarns 1-50 are listed right to left.
Figure 2B:
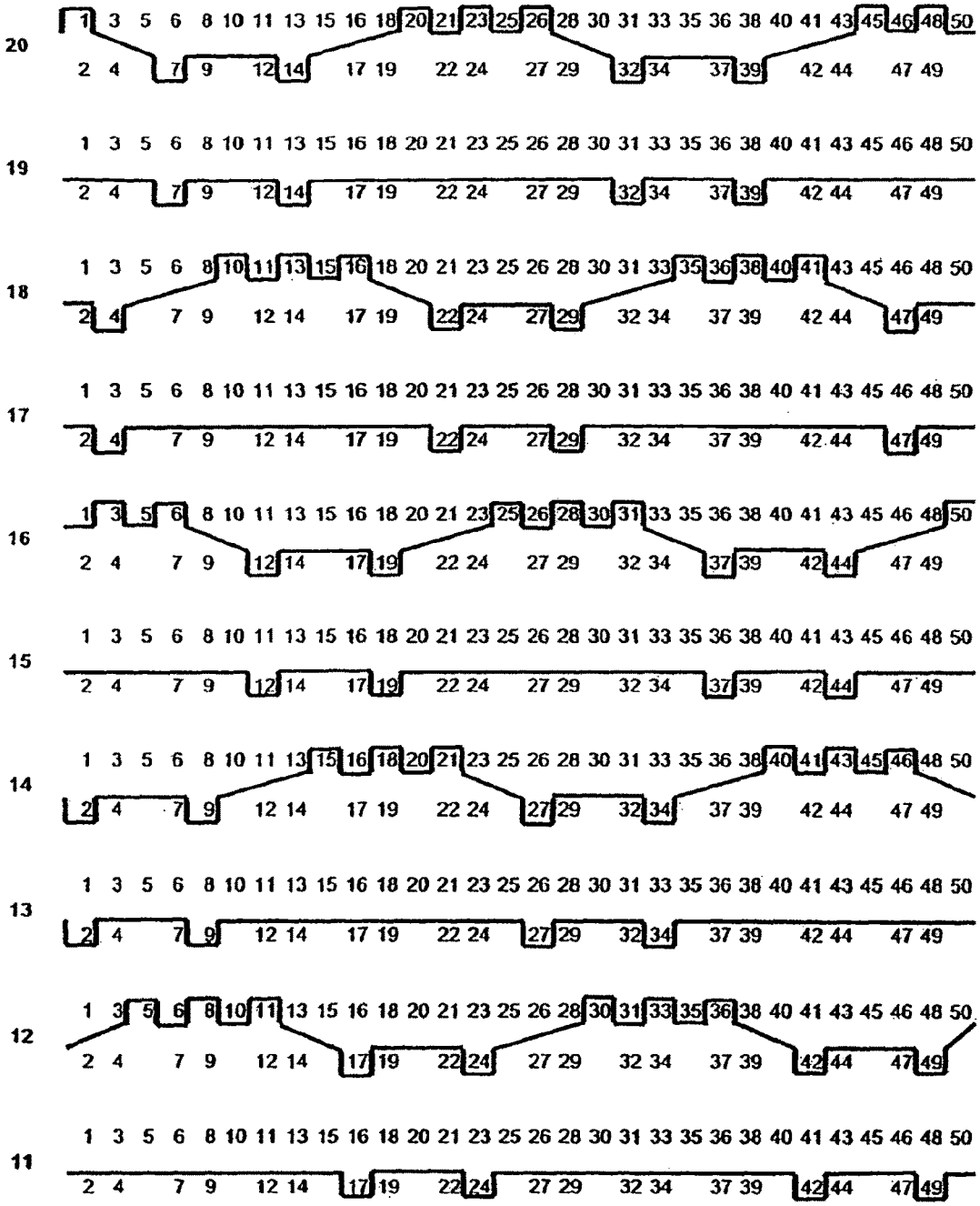
FIG. 2*b* shows a cross-section view of the repeat shown in FIG. 1 and illustrates binding warp yarns 12, 14, 16, 18 and 20 (listed from the bottom up on the left-hand side) and bottom warp yarns 11, 13, 15, 17 and 19 (listed from the bottom up on the left-hand side). The top and bottom weft yarns 1-50 are again listed right to left.

FIGS. 2*a* and 2*b* depict the paths of the upper and lower warp yarns 1-20 as they weave through the upper and lower weft yarns 1-50. The fabric of FIG. 1 thus shows a single repeat of the fabric that encompasses 50 weft yarns (yarns 1-50 represented horizontally in the figures) and 20 warp yarns (yarns 1-20 represented vertically in the figures). While FIGS. 1-2*b* only show a single repeat unit of the fabric, those of skill in the art will appreciate that in commercial applications, the repeat unit shown in FIGS. 1-2*b* would be repeated many times, in both the warp and weft directions, to form a large fabric suitable for use on a papermaking machine.

As seen in FIG. 2*a*, bottom warp yarn 1 passes under bottom weft yarns 2, 4, 7, 9, 12 and 14, then passes over bottom weft yarn 17, then passes under bottom weft yarns 19 and 22, then passes over bottom weft yarn 24, then passes under bottom weft yarns 27, 29, 32, 34, 37 and 39, then passes over bottom weft yarn 42, then passes under bottom weft yarns 44 and 47, and then passes over bottom weft yarn 49. The bottom warp yarn 1 weaves only in the bottom layer and only with non-adjacent bottom weft yarns, e.g., four non-adjacent bottom weft yarns 17, 24, 42 and 49.

Also seen in FIG. 2*a*, binding warp yarn 2 passes from the bottom layer to the top layer by passing under top weft yarns 1 and 3, then weaves with the top layer weft yarns 5, 6, 8, 10 and 11 to form a plain weave, then passes from the top layer to the bottom layer by passing under top weft yarns 13 and 15, then passes over bottom weft yarn 17, then passes under bottom weft yarns 19 and 22, then passes over bottom weft yarn 24, then passes from the bottom layer to the top layer by passing under top weft yarns 25, 26, and 28, then weaves with the top weft yarns 30, 31, 33, 35 and 36 to form a plain weave, then passes from the top layer to the bottom layer by passing under top weft yarns 38 and 40, then passes over bottom weft yarn 42, then passes under bottom weft yarns 44 and 47, then passes over bottom weft yarn 49, and then begins to pass back to the top layer. The binding warp yarn 2 binds to the bottom layer by weaving with the same non-adjacent bottom weft yarns that the bottom warp yarn 1 was woven with, e.g., by passing over the four non-adjacent bottom weft yarns 17, 24, 42 and 49.

FIG. 2*a* also illustrates bottom warp yarn 3 passing over bottom weft yarn 2, then passes under bottom weft yarns 4 and 7, then passes over bottom weft yarn 9, then passes under bottom weft yarns 12, 14, 17, 19, 22 and 24, then passes over bottom weft yarn 27, then passes under bottom weft yarns 29 and 32, then passes over bottom weft yarn 34, and then passes under bottom weft yarns 37, 39, 42, 44, 47 and 49. The bottom warp yarn 3 weaves only in the bottom layer and only with non-adjacent bottom weft yarns, e.g., four non-adjacent bottom weft yarns 2, 9, 27 and 34. The pattern formed by bottom warp yarn 3 is the same as that of bottom warp yarn 1 except that it is shifted sideways by six bottom weft yarns.

Also seen in FIG. 2*a*, binding warp yarn 4 passes over bottom weft yarn 2, then passes under bottom weft yarns 4 and 7, then passes over bottom weft yarn 9, then passes from the bottom layer to the top layer by passing under top weft yarns 10, 11 and 13, then weaves with the top layer weft yarns 15, 16, 18, 20 and 21 to form a plain weave, then passes from the top layer to the bottom layer by passing under top weft yarns 23 and 25, then passes over bottom weft yarn 27, then passes under bottom weft yarns 29 and 32, then passes over bottom weft yarn 34, then passes from the bottom layer to the top layer by passing under top weft yarns 35, 36, and 38, then weaves with the top weft yarns 40, 41, 43, 45 and 46 to form a plain weave, then passes from the top layer to the bottom layer by passing under top weft yarns 48 and 50. The binding warp yarn 4 binds to the bottom layer by weaving with the same non-adjacent bottom weft yarns that the bottom warp yarn 3 was woven with, e.g., by passing over the four non-adjacent bottom weft yarns 2, 9, 27 and 34. The pattern formed by binding warp yarn 4 is the same as that of binding warp yarn 2 except that it is shifted sideways by six top weft yarns.

FIG. 2*a* additionally shows bottom warp yarn 5 passing under bottom weft yarns 2, 4, 7 and 9, then passes over bottom weft yarn 12, then passes under bottom weft yarns 14 and 17, then passes over bottom weft yarn 19, then passes under bottom weft yarns 22, 24, 27, 29, 32 and 34, then passes over bottom weft yarn 37, then passes under bottom weft yarns 39 and 42, and then passes over bottom weft yarn 44, then passes under bottom weft yarns 47 and 49. The bottom warp yarn 5 weaves only in the bottom layer and only with non-adjacent bottom weft yarns, e.g., four non-adjacent bottom weft yarns 12, 19, 37 and 44. The pattern formed by bottom warp yarn 5 is the same as that of bottom warp yarn 3 except that it is shifted sideways by four bottom weft yarns.

Also seen in FIG. 2*a*, binding warp yarn 6 weaves with the top weft yarns 1, 3, 5 and 6 to form a plain weave, then passes from the top layer to the bottom layer by passing under top weft yarns 8 and 10, then passes over bottom weft yarn 12, then passes under bottom weft yarns 14 and 17, then passes over bottom weft yarn 19, then passes from the bottom layer to the top layer by passing under top weft yarns 20, 21 and 23, then weaves with the top weft yarns 25, 26, 28, 30 and 31 to form a plain weave, then passes from the top layer to the bottom layer by passing under top weft yarns 33 and 35, then passes over bottom weft yarn 37, then passes under bottom weft yarns 39 and 42, then passes over bottom weft yarn 44, then passes from the bottom layer to the top layer by passing under top weft yarns 45, 46 and 48, then passes over top weft yarn 50. The binding warp yarn 6 binds to the bottom layer by weaving with the same non-adjacent bottom weft yarns that the bottom warp yarn 5 was woven with, e.g., by passing over the four non-adjacent bottom weft yarns 12, 19, 37 and 44. The pattern formed by binding warp yarn 6 is the same as that of binding warp yarn 4 except that it is shifted sideways by six top weft yarns.

FIG. 2*a* further shows bottom warp yarn 7 passing under bottom weft yarn 2, then passes over bottom weft yarn 4, then passes under bottom weft yarns 7, 9, 12, 14, 17 and 19, then passes over bottom weft yarn 22, then passes under bottom weft yarns 24 and 27, then passes over bottom weft yarn 29, then passes under bottom weft yarns 32, 34, 37, 39, 42 and 44, and then passes over bottom weft yarn 44, then passes under bottom weft yarn 49. The bottom warp yarn 7 weaves only in the bottom layer and only with non-adjacent bottom weft yarns, e.g., four non-adjacent bottom weft yarns 4, 22, 29 and 47. The pattern formed by bottom warp yarn 7 is the same as that of bottom warp yarn 5 except that it is shifted sideways by four bottom weft yarns.

Also seen in FIG. 2*a*, binding warp yarn 8 passes under bottom weft yarn 2, then passes over bottom weft yarn 4, then passes from the bottom layer to the top layer by passing under top weft yarns 5, 6 and 8, then weaves with the top weft yarns 10, 11, 13, 15 and 16 to form a plain weave, then passes from the top layer to the bottom layer by passing under top weft yarns 18 and 20, then passes over bottom weft yarn 22, then passes under bottom weft yarns 24 and 27, then passes over bottom weft yarn 29, then passes from the bottom layer to the top layer by passing under top weft yarns 30, 31 and 33, then weaves with the top weft yarns 35, 36, 38, 40 and 41 to form a plain weave, then passes from the top layer to the bottom layer by passing under top weft yarns 43 and 45, then passes over bottom weft yarn 47, then passes under bottom weft yarn 49. The binding warp yarn 8 binds to the bottom layer by weaving with the same non-adjacent bottom weft yarns that the bottom warp yarn 7 was woven with, e.g., by passing over the four non-adjacent bottom weft yarns 4, 22, 29 and 47. The pattern formed by binding warp yarn 8 is the same as that of binding warp yarn 6 except that it is shifted sideways by six top weft yarns.

Additionally, FIG. 2*a* shows bottom warp yarn 9 passing under bottom weft yarns 2 and 4, then passes over bottom weft yarn 7, then passes under bottom weft yarns 9 and 12, then passes over bottom weft yarn 14, then passes under bottom weft yarns 17, 19, 22, 24, 27 and 29, then passes over bottom weft yarn 32, then passes under bottom weft yarns 34 and 37, and then passes over bottom weft yarn 39, then passes under bottom weft yarns 42, 44, 47 and 49. The bottom warp yarn 9 weaves only in the bottom layer and only with non-adjacent bottom weft yarns, e.g., four non-adjacent bottom weft yarns 7, 14, 32 and 39. The pattern formed by bottom warp yarn 9 is the same as that of bottom warp yarn 7 except that it is shifted sideways by four bottom weft yarns.

Finally, FIG. 2*a* shows binding warp yarn 10 passing over the top weft yarn 1, then passes from the top layer to the bottom layer by passing under top weft yarns 3 and 5, then passes over bottom weft yarn 7, then passes under bottom weft yarns 9 and 12, then passes over bottom weft yarn 14, then passes from the bottom layer to the top layer by passing under top weft yarns 15, 16 and 18, then weaves with the top weft yarns 20, 21, 23, 25 and 26 to form a plain weave, then passes from the top layer to the bottom layer by passing under top weft yarns 28 and 30, then passes over bottom weft yarn 32, then passes under bottom weft yarns 34 and 37, then passes over bottom weft yarn 39, then passes from the bottom layer to the top layer by passing under top weft yarns 40, 41 and 43, then weaves with binding warp yarns 45, 46, 48 and 50 to form a plain weave. The binding warp yarn 10 binds to the bottom layer by weaving with the same non-adjacent bottom weft yarns that the bottom warp yarn 9 was woven with, e.g., by passing over the four non-adjacent bottom weft yarns 7, 14, 32 and 39. The pattern formed by binding warp yarn 10 is the same as that of binding warp yarn 8 except that it is shifted sideways by six top weft yarns.

With reference to FIG. 2*b*, bottom warp yarn 11 passes under bottom weft yarns 2, 4, 7, 9, 12 and 14, then passes over bottom weft yarn 17, then passes under bottom weft yarns 19 and 22, then passes over bottom weft yarn 24, then passes under bottom weft yarns 27, 29, 32, 34, 37 and 39, then passes over bottom weft yarn 42, then passes under bottom weft yarns 44 and 47, and then passes over bottom weft yarn 49. The bottom warp yarn 11 weaves only in the bottom layer and only with non-adjacent bottom weft yarns, e.g., four non-adjacent bottom weft yarns 17, 24, 42 and 49.

Also seen in FIG. 2*b*, binding warp yarn 12 passes from the bottom layer to the top layer by passing under top weft yarns 1 and 3, then weaves with the top layer weft yarns 5, 6, 8, 10 and 11 to form a plain weave, then passes from the top layer to the bottom layer by passing under top weft yarns 13 and 15, then passes over bottom weft yarn 17, then passes under bottom weft yarns 19 and 22, then passes over bottom weft yarn 24, then passes from the bottom layer to the top layer after passing under top weft yarns 25, 26, and 28, then weaves with the top weft yarns 30, 31, 33, 35 and 36 to form a plain weave, then passes from the top layer to the bottom layer by passing under top weft yarns 38 and 40, then passes over bottom weft yarn 42, then passes under bottom weft yarns 44 and 47, then passes over bottom weft yarn 49, and then begins to pass back to the top layer. The binding warp yarn 12 binds to the bottom layer by weaving with the same non-adjacent bottom weft yarns that the bottom warp yarn 11 was woven with, e.g., by passing over the four non-adjacent bottom weft yarns 17, 24, 42 and 49.

FIG. 2*b* also illustrates bottom warp yarn 13 passing over bottom weft yarn 2, then passes under bottom weft yarns 4 and 7, then passes over bottom weft yarn 9, then passes under bottom weft yarns 12, 14, 17, 19, 22 and 24, then passes over bottom weft yarn 27, then passes under bottom weft yarns 29 and 32, then passes over bottom weft yarn 34, and then passes under bottom weft yarns 37, 39, 42, 44, 47 and 49. The bottom warp yarn 13 weaves only in the bottom layer and only with non-adjacent bottom weft yarns, e.g., four non-adjacent bottom weft yarns 2, 9, 27 and 34. The pattern formed by bottom warp yarn 13 is the same as that of bottom warp yarn 11 except that it is shifted sideways by six bottom weft yarns.

Also seen in FIG. 2*b*, binding warp yarn 14 passes over bottom weft yarn 2, then passes under bottom weft yarns 4 and 7, then passes over bottom weft yarn 9, then passes from the bottom layer to the top layer by passing under top weft yarns 10, 11 and 13, then weaves with the top layer weft yarns 15, 16, 18, 20 and 21 to form a plain weave, then passes from the top layer to the bottom layer by passing under top weft yarns 23 and 25, then passes over bottom weft yarn 27, then passes under bottom weft yarns 29 and 32, then passes over bottom weft yarn 34, then passes from the bottom layer to the top layer by passing under top weft yarns 35, 36, and 38, then weaves with the top weft yarns 40, 41, 43, 45 and 46 to form a plain weave, then passes from the top layer to the bottom layer by passing under top weft yarns 48 and 50. The binding warp yarn 14 binds to the bottom layer by weaving with the same non-adjacent bottom weft yarns that the bottom warp yarn 13 was woven with, e.g., by passing over the four non-adjacent bottom weft yarns 2, 9, 27 and 34. The pattern formed by binding warp yarn 14 is the same as that of binding warp yarn 12 except that it is shifted sideways by six top weft yarns.

FIG. 2*b* also illustrates bottom warp yarn 15 passing under bottom weft yarns 2, 4, 7 and 9, then passes over bottom weft yarn 12, then passes under bottom weft yarns 14 and 17, then passes over bottom weft yarn 19, then passes under bottom weft yarns 22, 24, 27, 29, 32 and 34, then passes over bottom weft yarn 37, then passes under bottom weft yarns 39 and 42, and then passes over bottom weft yarn 44, then passes under bottom weft yarns 47 and 49. The bottom warp yarn 15 weaves only in the bottom layer and only with non-adjacent bottom weft yarns, e.g., four non-adjacent bottom weft yarns 12, 19, 37 and 44. The pattern formed by bottom warp yarn 15 is the same as that of bottom warp yarn 13 except that it is shifted sideways by four bottom weft yarns.

Also seen in FIG. 2*b*, binding warp yarn 16 weaves with the top weft yarns 1, 3, 5 and 6 to form a plain weave, then passes from the top layer to the bottom layer by passing under top weft yarns 8 and 10, then passes over bottom weft yarn 12, then passes under bottom weft yarns 14 and 17, then passes over bottom weft yarn 19, then passes from the bottom layer to the top layer by passing under top weft yarns 20, 21 and 23, then weaves with the top weft yarns 25, 26, 28, 30 and 31 to form a plain weave, then passes from the top layer to the bottom layer by passing under top weft yarns 33 and 35, then passes over bottom weft yarn 37, then passes under bottom weft yarns 39 and 42, then passes over bottom weft yarn 44, then passes from the bottom layer to the top layer by passing under top weft yarns 45, 46 and 48, then passes over top weft yarn 50. The binding warp yarn 16 binds to the bottom layer by weaving with the same non-adjacent bottom weft yarns that the bottom warp yarn 15 was woven with, e.g., by passing over the four non-adjacent bottom weft yarns 12, 19, 37 and 44. The pattern formed by binding warp yarn 16 is the same as that of binding warp yarn 14 except that it is shifted sideways by six top weft yarns.

FIG. 2*b* further illustrates bottom warp yarn 17 passing under bottom weft yarn 2, then passes over bottom weft yarn 4, then passes under bottom weft yarns 7, 9, 12, 14, 17 and 19, then passes over bottom weft yarn 22, then passes under bottom weft yarns 24 and 27, then passes over bottom weft yarn 29, then passes under bottom weft yarns 32, 34, 37, 39, 42 and 44, and then passes over bottom weft yarn 44, then passes under bottom weft yarn 49. The bottom warp yarn 17 weaves only in the bottom layer and only with non-adjacent bottom weft yarns, e.g., four non-adjacent bottom weft yarns 4, 22, 29 and 47. The pattern formed by bottom warp yarn 17 is the same as that of bottom warp yarn 15 except that it is shifted sideways by four bottom weft yarns.

FIG. 2*b* further shows binding warp yarn 18 passing under bottom weft yarn 2, then passes over bottom weft yarn 4, then passes from the bottom layer to the top layer by passing under top weft yarns 5, 6 and 8, then weaves with the top weft yarns 10, 11, 13, 15 and 16 to form a plain weave, then passes from the top layer to the bottom layer by passing under top weft yarns 18 and 20, then passes over bottom weft yarn 22, then passes under bottom weft yarns 24 and 27, then passes over bottom weft yarn 29, then passes from the bottom layer to the top layer by passing under top weft yarns 30, 31 and 33, then weaves with the top weft yarns 35, 36, 38, 40 and 41 to form a plain weave, then passes from the top layer to the bottom layer by passing under top weft yarns 43 and 45, then passes over bottom weft yarn 47, then passes under bottom weft yarn 49. The binding warp yarn 18 binds to the bottom layer by weaving with the same non-adjacent bottom weft yarns that the bottom warp yarn 17 was woven with, e.g., by passing over the four non-adjacent bottom weft yarns 4, 22, 29 and 47. The pattern formed by binding warp yarn 18 is the same as that of binding warp yarn 16 except that it is shifted sideways by six top weft yarns.

FIG. 2*b* also shows bottom warp yarn 19 passing under bottom weft yarns 2 and 4, then passes over bottom weft yarn 7, then passes under bottom weft yarns 9 and 12, then passes over bottom weft yarn 14, then passes under bottom weft yarns 17, 19, 22, 24, 27 and 29, then passes over bottom weft yarn 32, then passes under bottom weft yarns 34 and 37, and then passes over bottom weft yarn 39, then passes under bottom weft yarns 42, 44, 47 and 49. The bottom warp yarn 19 weaves only in the bottom layer and only with non-adjacent bottom weft yarns, e.g., four non-adjacent bottom weft yarns 7, 14, 32 and 39. The pattern formed by bottom warp yarn 19 is the same as that of bottom warp yarn 17 except that it is shifted sideways by four bottom weft yarns.

Finally, as seen in FIG. 2*b*, binding warp yarn 20 passes over the top weft yarn 1, then passes from the top layer to the bottom layer by passing under top weft yarns 3 and 5, then passes over bottom weft yarn 7, then passes under bottom weft yarns 9 and 12, then passes over bottom weft yarn 14, then passes from the bottom layer to the top layer by passing under top weft yarns 15, 16 and 18, then weaves with the top weft yarns 20, 21, 23, 25 and 26 to form a plain weave, then passes from the top layer to the bottom layer by passing under top weft yarns 28 and 30, then passes over bottom weft yarn 32, then passes under bottom weft yarns 34 and 37, then passes over bottom weft yarn 39, then passes from the bottom layer to the top layer by passing under top weft yarns 40, 41 and 43, then weaves with binding warp yarns 45, 46, 48 and 50 to form a plain weave. The binding warp yarn 20 binds to the bottom layer by weaving with the same non-adjacent bottom weft yarns that the bottom warp yarn 19 was woven with, e.g., by passing over the four non-adjacent bottom weft yarns 7, 14, 32 and 39. The pattern formed by binding warp yarn 20 is the same as that of binding warp yarn 18 except that it is shifted sideways by six top weft yarns.

As is apparent from a comparison of FIG. 2*a* and 2*b*, the paths taken by the warp yarns 1-10 through the weft yarns 1-50 are respectively the same as paths taken by the warp yarns 11-20 through the weft yarns 1-50, i.e., warp yarn 1 has the same path through the weft yarns 1-50 as warp yarn 11, warp yarn 2 has the same path through the weft yarns 1-50 as warp yarn 12, etc,.

Figure 3:
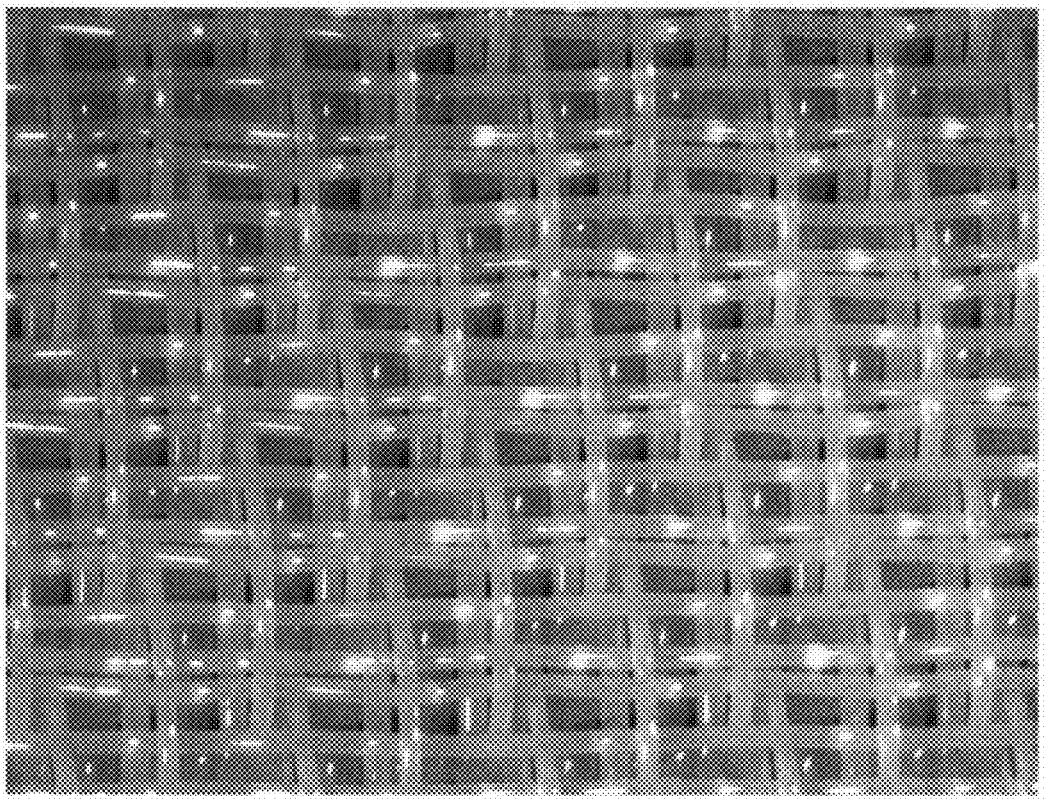
FIG. 3 shows a photograph of a top side or paper facing side of an actual forming fabric utilizing the weave pattern shown in FIGS. 1-2*b;*
Figure 4:
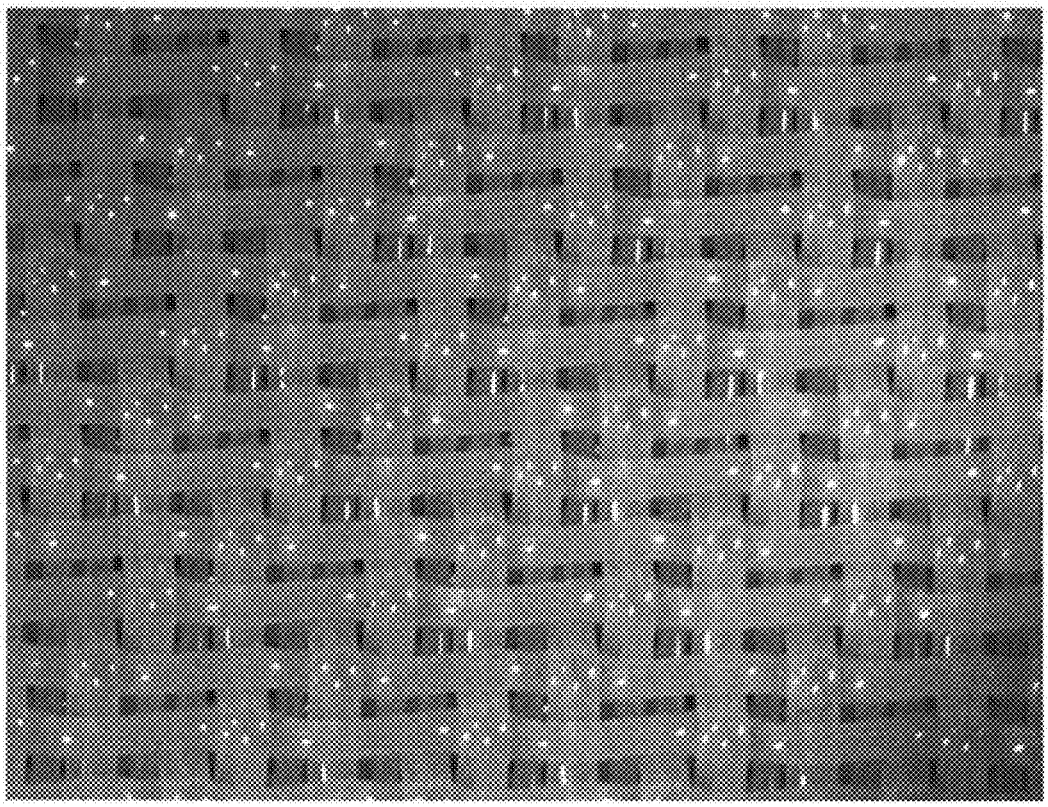
FIG. 4 shows a photograph of a bottom side or machine side of the forming fabric shown in FIG. 3.

FIG. 3 shows a photograph of a top side or paper facing side of an actual forming fabric utilizing the weave pattern shown in FIG. 1 and FIG. 4 shows a photograph of a bottom side or machine side of the forming fabric shown in FIG. 3.

By way of non-limiting example, the binding warp yarns 2, 4, 6, 8, 10, 12, 14, 16, 18 and 20 of the embodiment shown in FIGS. 1-2*b* can have the following characteristics: acceptable size range of between approximately 0.10 mm and approximately 0.50 mm, preferable size ranges of between approximately 0.20 mm and approximately 0.80 mm, and most preferred size range of between approximately 0.12 mm and approximately 0.20 mm. The material for these yarns can be any natural or synthetic material, preferably a synthetic monofilament, and most preferably a polyester monofilament.

By way of non-limiting example, the bottom warp yarns 1, 3, 5, 7, 9, 11, 13, 15, 17 and 19 of the embodiment shown in FIGS. 1-2*b* can have the following characteristics: acceptable size range of between approximately 0.15 mm and approximately 0.60 mm, preferable size ranges of between approximately 0.20 mm and approximately 0.40 mm, and most preferred size range of between approximately 0.25 mm and approximately 0.35 mm. The material for these yarns can be any natural or synthetic material, preferably a synthetic monofilament, and most preferably a polyester monofilament. The bottom warp yarns can preferably be constructed using relatively large diameter yarns that are well suited to sustain the wear caused by the friction between the machine side surface of the fabric and the papermaking machine during use of the fabric.

By way of non-limiting example, the top weft yarns 1, 3, 5, 6, 8, 10, 11, 13, 15, 16, 18, 20, 21, 23, 25, 26, 28, 30, 31, 33, 35, 36, 38, 40, 41, 43, 45, 46, 48 and 50 of the embodiment shown in FIGS. 1-2*b* can have the following characteristics: acceptable size range of between approximately 0.10 mm and approximately 0.50 mm, preferable size ranges of between approximately 0.20 mm and approximately 0.80 mm, and most preferred size range of between approximately 0.12 mm and approximately 0.80 mm. The material for these yarns can be any natural or synthetic material, preferably a synthetic monofilament, and most preferably a polyester monofilament.

By way of non-limiting example, the bottom weft yarns 2, 4, 7, 9, 12, 14, 17, 19, 22, 24, 27, 29, 32, 34, 37, 39, 42, 44, 47 and 49 of the embodiment shown in FIGS. 1-2*b* can have the following characteristics: acceptable size range of between approximately 0.15 mm and approximately 0.60 mm, preferable size ranges of between approximately 0.20 mm and approximately 0.40 mm, and most preferred size range of between approximately 0.25 mm and approximately 0.35 mm. The material for these yarns can be any natural or synthetic material, preferably a synthetic monofilament, and most preferably a polyester monofilament. These bottom weft yarns may also be constructed using larger diameter yarns than the upper warp yarns.

In the embodiment shown in FIGS. 1-2*b* all of the binding warp yarns form a plain weave in the top layer by weaving with five top weft yarns and bind to the bottom layer by weaving with four bottom weft yarns with a non-plain weave in two spaced apart locations, i.e., spaced apart by ten top weft yarns and/or sic bottom weft yarns in each repeat of the fabric. Furthermore, all of the bottom warp yarns weave only in the bottom layer. Additionally, when a binding warp yarn passes from the bottom layer to the top layer, it passes under three adjacent top weft yarns before weaving with a plain weave in the top layer. When a binding warp yarn passes from the top layer to the bottom layer, it passes under two adjacent top weft yarns before weaving with a non-plain weave in the bottom layer. Thus, the area of the plain weave (between a binding warp yarn and top weft yarns) is off-center with respect to an area or spacing between the two areas where the same binding warp yarn weaves to the bottom layer. Also, in the area or spacing between two the plain weave areas (between a binding warp yarn and top weft yarns), the area where the binding warp weaves with the bottom layer is off-center. These features are also desirable in numerous papermaking applications.

FIG. 5 shows a second non-limiting embodiment of the invention and depicts a top pattern view of the top fabric layer of the multilayer fabric (i.e., a view of the papermaking surface). The numbers 1-20 shown on the bottom of the pattern identify the upper and lower warp yarns while the right side numbers 1-45 show the upper and lower weft yarns. The upper warp yarns shown on the bottom of the pattern are 1, 3, 5, 7, 9, 11, 13, 15, 17 and 19. The lower warp yarns shown on the bottom of the pattern are 2, 4, 6, 8, 10, 12, 14, 16, 18 and 20. The top weft yarns shown on the right side of the pattern are 1, 3, 4, 6, 7, 9, 10, 12, 13, 15, 16, 18, 19, 21, 22, 24, 25, 27, 28, 30, 31, 33, 34, 36, 37, 39, 40, 42, 43 and 45. The bottom weft yarns shown on the right side of the pattern are 2, 5, 8, 11, 14, 17, 20, 23, 26, 29, 32, 35, 38, 41 and 44.

Also in FIG. 5, a blank cell is shown in locations where a binding warp yarn passes under a top weft yarn while a bottom warp yarn passes under a bottom weft yarn. Symbol X is shown in locations where a binding warp yarn passes over a top weft yarn while a bottom warp yarn passes under a bottom weft yarn. A shaded cell is shown in locations where a binding warp yarn passes over a bottom weft yarn while a bottom warp yarn passes over the same bottom weft yarn. As used herein, the term "over" in reference to a weave pattern of a warp yarn in the top layer means that the yarn passes vertically above a paper-side surface of the fabric and then over a top weft yarn. The term "over" in reference to a weave pattern of a warp yarn in the bottom layer means that the yarn passes vertically below a machine-side surface and then over a top weft yarn as opposed to passing between the top and bottom weft yarns.

Figure 6A:
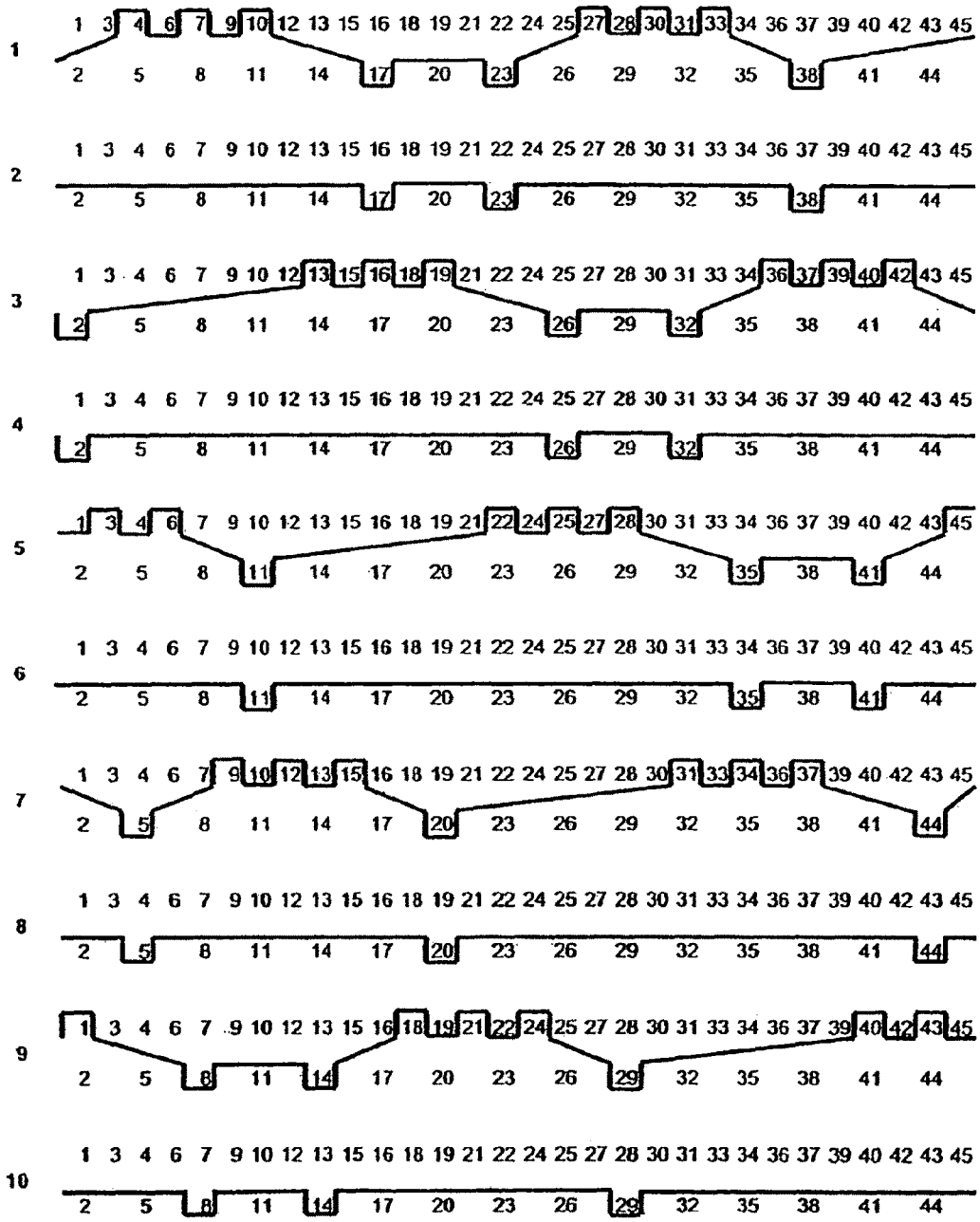
FIG. 6*a* shows a cross-section view of the repeat shown in FIG. 6 and illustrates binding warp yarns 1, 3, 5, 7 and 9 (listed from the top down on the left-hand side) and bottom warp yarns 2, 4, 6, 8 and 10 (listed from the top down on the left-hand side). The top and bottom weft yarns 1-45 are listed right to left.
Figure 6B:
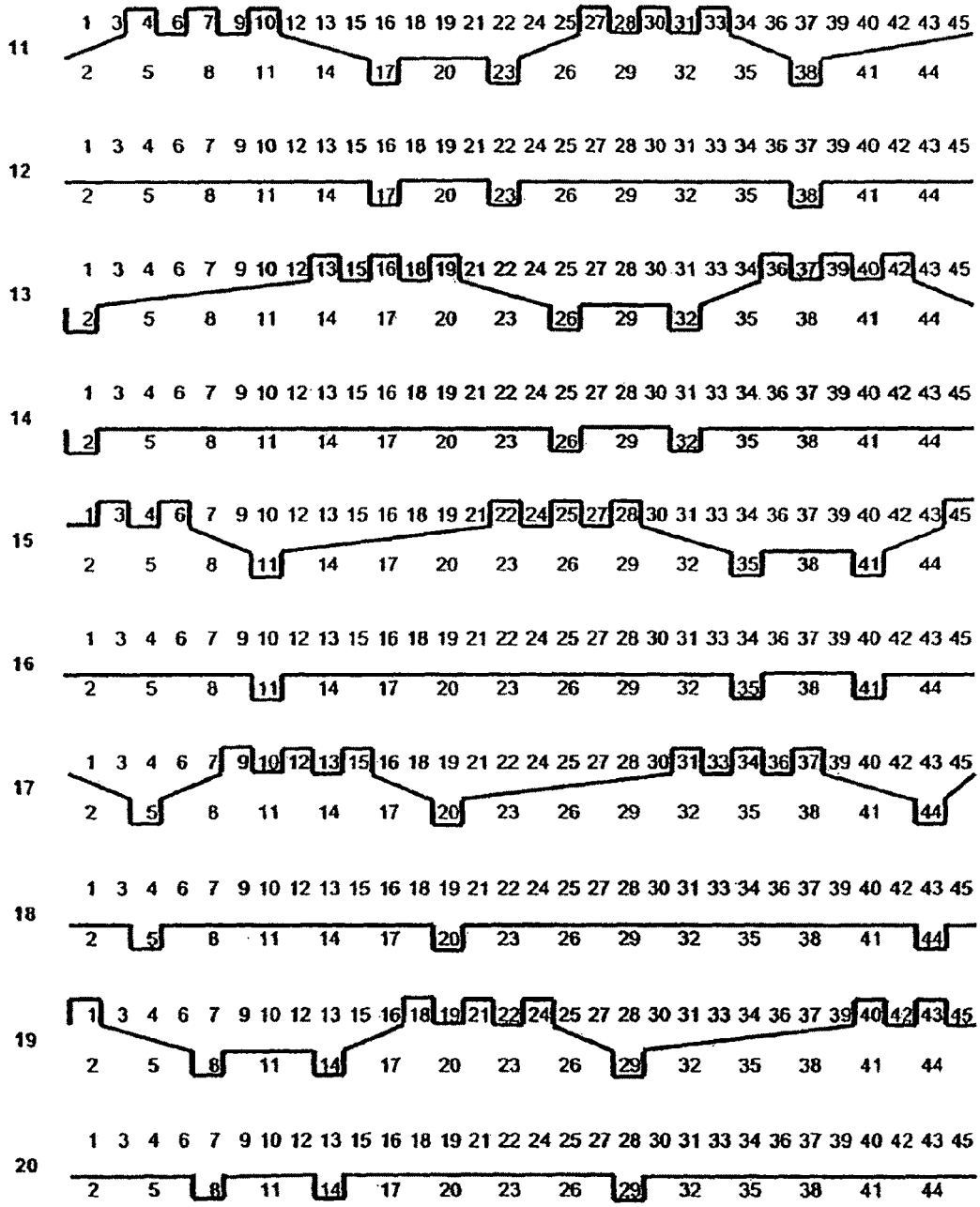
FIG. 6*b* shows a cross-section view of the repeat shown in FIG. 6 and illustrates binding warp yarns 11, 13, 15, 17 and 19 (listed from the top down on the left-hand side) and bottom warp yarns 12, 14, 16, 18 and 20 (listed from the top down on the left-hand side). The top and bottom weft yarns 145 are again listed right to left.

FIGS. 6*a* and 6*b* depict the paths of the upper and lower warp yarns 1-20 as they weave through the upper and lower weft yarns 1-45. The fabric of FIG. 5 thus shows a single repeat of the fabric that encompasses 45 weft yarns (yarns 1-45 represented horizontally in the figures) and 20 warp yarns (yarns 1-20 represented vertically in the figures). While FIGS. 5-6*b* only show a single repeat unit of the fabric, those of skill in the art will appreciate that in commercial applications, the repeat unit shown in FIGS. 5-6*b* would be repeated many times, in both the warp and weft directions, to form a large fabric suitable for use on a papermaking machine.

As seen in FIG. 6*a*, binding warp yarn 1 passes from the bottom layer to the top layer by passing under top weft yarns 1 and 3, then weaves with the top layer weft yarns 4, 6, 7, 9 and 10 to form a plain weave, then passes from the top layer to the bottom layer by passing under top weft yarns 12, 13 and 15, then passes over bottom weft yarn 17, then passes under bottom weft yarn 20, then passes over bottom weft yarn 23, then passes from the bottom layer to the top layer by passing under top weft yarns 24 and 25, then weaves with the top weft yarns 27, 28, 30, 31 and 33 to form a plain weave, then passes from the top layer to the bottom layer by passing under top weft yarns 34 and 36, then passes over bottom weft yarn 38, then passes back to the top layer by passing under top weft yarns 39, 40, 42, 43 and 45. The binding warp yarn 1 binds to the bottom layer by weaving with the same adjacent bottom weft yarns that the bottom warp yarn 2 was woven with, e.g., by passing over the three non-adjacent bottom weft yarns 17, 23 and 38.

Also seen in FIG. 6*a*, bottom warp yarn 2 passes under bottom weft yarns 2, 5, 8, 11 and 14, then passes over bottom weft yarn 17, then passes under bottom weft yarn 20, then passes over bottom weft yarn 23, then passes under bottom weft yarns 26, 29, 32 and 35, then passes over bottom weft yarn 38, then passes under bottom weft yarns 41 and 44. The bottom warp yarn 2 weaves only in the bottom layer, weaves first with three adjacent bottom weft yarns, e.g., bottom weft yarns 17, 20 and 23, and then binds with only one bottom weft yarn, e.g., bottom weft yarn 38.

FIG. 6*a* also illustrates binding warp yarn 3 passing over bottom weft yarn 2, then passes under bottom weft yarns 3, 4, 6, 7, 9, 10 and 12, then weaves with the top layer weft yarns 13, 15, 16, 18 and 19 to form a plain weave, then passes from the top layer to the bottom layer by passing under top weft yarns 21, 22 and 24, then passes over bottom weft yarn 26, then passes under bottom weft yarn 29, then passes over bottom weft yarn 32, then passes from the bottom layer to the top layer by passing under top weft yarns 33 and 34, then weaves with the top weft yarns 36, 37, 39, 40 and 42 to form a plain weave, then passes from the top layer to the bottom layer by passing under top weft yarns 43 and 45. The binding warp yarn 3 binds to the bottom layer by weaving with the same bottom weft yarns that the bottom warp yarn 4 was woven with, e.g., by passing over the three non-adjacent bottom weft yarns 2, 26 and 32. The pattern formed by binding warp yarn 3 is different from that of binding warp yarn 1 in both position and weaving path.

Also seen in FIG. 6*a*, bottom warp yarn 4 passes over bottom weft yarn 2, then passes under bottom weft yarns 5, 8, 11, 14, 17, 20 and 23, then passes over bottom weft yarn 26, then passes under bottom weft yarn 29, then passes over bottom weft yarn 32, then passes under bottom weft yarns 35, 38, 41 and 44. The bottom warp yarn 4 weaves only in the bottom layer, weaves first with one bottom weft yarn, e.g., bottom weft yarn 2, and then weaves with three bottom weft yarns, e.g., bottom, weft yarns 26, 29 and 32. The pattern formed by bottom warp yarn 4 is the same as that of bottom warp yarn 2 except that it is shifted sideways by three bottom weft yarns.

FIG. 6*a* also shows binding warp yarn 5 weaving with the top weft yarns 1, 3, 4 and 6 to form a plain weave, then passes from the top layer to the bottom layer by passing under top weft yarns 7 and 9, then passes over bottom weft yarn 11, then passes from the bottom layer to the top layer by passing under top weft yarns 12,13, 15, 16, 18, 19 and 21, then weaves with the top weft yarns 22, 24, 25, 27 and 28 to form a plain weave, then passes from the top layer to the bottom layer by passing under top weft yarns 30, 31 and 33, then passes over bottom weft yarn 35, then passes under bottom weft yarn 38, then passes over bottom weft yarn 41, then passes from the bottom layer to the top layer by passing under top weft yarns 42 and 43, then passes over top weft yarn 45. The binding warp yarn 5 binds to the bottom layer by weaving with the same bottom weft yarns that the bottom warp yarn 6 weaves with, e.g., by passing over the three non-adjacent bottom weft yarns 11, 35 and 41. The pattern formed by binding warp yarn 5 is the same as that of binding warp yarn 3 except that it is shifted sideways by nine top weft yarns.

As seen in FIG. 6*a*, bottom warp yarn 6 passes under bottom weft yarns 2, 5 and 8, then passes over bottom weft yarn 11, then passes under bottom weft yarns 14, 17, 20, 23, 26, 29 and 32, then passes over bottom weft yarn 35, then passes under bottom weft yarn 38, then passes over bottom weft yarn 41, then passes under bottom weft yarn 44. The bottom warp yarn 6 weaves only in the bottom layer, weaves first with one bottom weft yarn, e.g., bottom weft yarn 11, and then weaves with three bottom weft yarns, e.g., bottom weft yarns 35, 38 and 41. The pattern formed by bottom warp yarn 6 is the same as that of bottom warp yarn 4 except that it is shifted sideways by three bottom weft yarns.

Additionally, FIG. 6*a* shows binding warp yarn 7 passing from the top layer to the bottom layer by passing under top weft yarns 1 and 3, then under bottom weft yarn 5, then passes from the bottom layer to the top layer by passing under top weft yarns 6 and 7, then weaves with the top weft yarns 9, 10, 12, 13 and 15 to form a plain weave, then passes from the top layer to the bottom layer by passing under top weft yarns 16 and 18, then passes over bottom weft yarn 20, then passes from the bottom layer to the top layer by passing under top weft yarns 21, 22, 24, 25, 27, 28 and 30, then weaves with the top weft yarns 31, 33, 34, 36 and 37 to form a plain weave, then passes from the top layer to the bottom layer by passing under top weft yarns 39, 40 and 42, then passes over bottom weft yarn 44, then begins to pass back to the top layer from the bottom layer by passing under top weft yarn 45. The binding warp yarn 7 binds to the bottom layer by weaving with the same non-adjacent bottom weft yarns that the bottom warp yarn 8 weaves with, e.g., by passing over the three non-adjacent bottom weft yarns 5, 20 and 44. The pattern formed by binding warp yarn 7 is different from that of the binding warp yarns 1, 3, 5 and 9.

As seen in FIG. 6*a*, bottom warp yarn 8 passes under bottom weft yarn 2, then passes over bottom weft yarn 5, then passes under bottom weft yarns 8, 11, 14 and 17, then passes over bottom weft yarn 20, then passes under bottom weft yarns 23, 26, 29, 32, 35, 38 and 41, then passes over bottom weft yarn 44. The bottom warp yarn 8 weaves only in the bottom layer and only with non-adjacent bottom weft yarns, e.g., three non-adjacent bottom weft yarns 5, 20 and 44. The pattern formed by bottom warp yarn 8 is different from that of the bottom warp yarns 2, 4, 6 and 10.

Furthermore, FIG. 6*a* shows binding warp yarn 9 passing over the top weft yarn 1, then passes from the top layer to the bottom layer by passing under top weft yarns 3, 4 and 6, then passes over bottom weft yarn 8, then passes under bottom weft yarn 11, then passes over bottom weft yarn 14, then passes from the bottom layer to the top layer by passing under top weft yarns 15 and 16, then weaves with the top weft yarns 18, 19, 21, 22 and 24 to form a plain weave, then passes from the top layer to the bottom layer by passing under top weft yarns 25 and 27, then passes over bottom weft yarn 29, then passes from the bottom layer to the top layer by passing under top weft yarns 30, 31, 33, 34, 36, 37 and 39, then weaves with top weft yarns 40, 42, 43 and 45 to form a plain weave. The binding warp yarn 9 binds to the bottom layer by weaving with the same bottom weft yarns that the bottom warp yarn 10 weaves with, e.g., by passing over the three non-adjacent bottom weft yarns 8, 14 and 29. The pattern formed by binding warp yarn 9 is the same as that of binding warp yarn 1 except that it is shifted sideways by six top weft yarns.

Finally, as seen in FIG. 6*a*, bottom warp yarn 10 passes under bottom weft yarns 2 and 5, then passes over bottom weft yarn 8, then passes under bottom weft yarn 11, then passes over bottom weft yarn 14, then passes under bottom weft yarns 17, 20, 23 and 26, then passes over bottom weft yarn 29, then passes under bottom weft yarns 32, 35, 38, 41 and 44. The bottom warp yarn 10 weaves only in the bottom layer and only with non-adjacent bottom weft yarns, e.g., three bottom weft yarns 8, 14 and 29. The pattern formed by bottom warp yarn 10 is the same as that of bottom warp yarn 2 except that it is shifted sideways by three bottom weft yarns.

With reference to FIG. 6*b*, binding warp yarn 11 passes from the bottom layer to the top layer by passing under top weft yarns 1 and 3, then weaves with the top layer weft yarns 4, 6, 7, 9 and 10 to form a plain weave, then passes from the top layer to the bottom layer by passing under top weft yarns 12, 13 and 15, then passes over bottom weft yarn 17, then passes under bottom weft yarn 20, then passes over bottom weft yarn 23, then passes from the bottom layer to the top layer by passing under top weft yarns 24 and 25, then weaves with the top weft yarns 27, 28, 30, 31 and 33 to form a plain weave, then passes from the top layer to the bottom layer by passing under top weft yarns 34 and 36, then passes over bottom weft yarn 38, then passes back to the top layer by passing under top weft yarns 39, 40, 42, 43 and 45. The binding warp yarn 11 binds to the bottom layer by weaving with the same adjacent bottom weft yarns that the bottom warp yarn 12 was woven with, e.g., by passing over the three non-adjacent bottom weft yarns 17, 23 and 38.

Also seen in FIG. 6*b*, bottom warp yarn 12 passes under bottom weft yarns 2, 5, 8, 11 and 14, then passes over bottom weft yarn 17, then passes under bottom weft yarn 20, then passes over bottom weft yarn 23, then passes under bottom weft yarns 26, 29, 32 and 35, then passes over bottom weft yarn 38, then passes under bottom weft yarns 41 and 44. The bottom warp yarn 12 weaves only in the bottom layer, weaves first with three adjacent bottom weft yarns, e.g., bottom weft yarns 17, 20 and 23, and then binds with only one bottom weft yarn, e.g., bottom weft yarn 38.

FIG. 6*b* also illustrates binding warp yarn 13 passing over bottom weft yarn 2, then passes under bottom weft yarns 3, 4, 6, 7, 9, 10 and 12, then weaves with the top layer weft yarns 13, 15,16, 18 and 19 to form a plain weave, then passes from the top layer to the bottom layer by passing under top weft yarns 21, 22 and 24, then passes over bottom weft yarn 26, then passes under bottom weft yarn 29, then passes over bottom weft yarn 32, then passes from the bottom layer to the top layer by passing under top weft yarns 33 and 34, then weaves with the top weft yarns 36, 37, 39, 40 and 42 to form a plain weave, then passes from the top layer to the bottom layer by passing under top weft yarns 43 and 45. The binding warp yarn 13 binds to the bottom layer by weaving with the same bottom weft yarns that the bottom warp yarn 14 was woven with, e.g., by passing over the three non-adjacent bottom weft yarns 2, 26 and 32. The pattern formed by binding warp yarn 13 is different from that of binding warp yarn 11 in both position and weaving path.

Also seen in FIG. 6*b*, bottom warp yarn 14 passes over bottom weft yarn 2, then passes under bottom weft yarns 5, 8, 11, 14, 17, 20 and 23, then passes over bottom weft yarn 26, then passes under bottom weft yarn 29, then passes over bottom weft yarn 32, then passes under bottom weft yarns 35, 38, 41 and 44. The bottom warp yarn 14 weaves only in the bottom layer, weaves first with one bottom weft yarn, e.g., bottom weft yarn 2, and then weaves with three bottom weft yarns, e.g., bottom weft yarns 26, 29 and 32. The pattern formed by bottom warp yarn 14 is the same as that of bottom warp yarn 12 except that it is shifted sideways by three bottom weft yarns.

FIG. 6*b* also illustrates binding warp yarn 15 weaving with the top weft yarns 1, 3, 4 and 6 to form a plain weave, then passes from the top layer to the bottom layer by passing under top weft yarns 7 and 9, then passes over bottom weft yarn 11, then passes from the bottom layer to the top layer by passing under top weft yarns 12, 13, 15, 16, 18, 19 and 21, then weaves with the top weft yarns 22, 24, 25, 27 and 28 to form a plain weave, then passes from the top layer to the bottom layer by passing under top weft yarns 30, 31 and 33, then passes over bottom weft yarn 35, then passes under bottom weft yarn 38, then passes over bottom weft yarn 41, then passes from the bottom layer to the top layer by passing under top weft yarns 42 and 43, then passes over top weft yarn 45. The binding warp yarn 15 binds to the bottom layer by weaving with the same bottom weft yarns that the bottom warp yarn 16 weaves with, e.g., by passing over the three non-adjacent bottom weft yarns 11, 35 and 41. The pattern formed by binding warp yarn 15 is the same as that of binding warp yarn 13 except that it is shifted sideways by nine top weft yarns.

Additionally, FIG. 6*b* shows bottom warp yarn 16 passing under bottom weft yarns 2, 5 and 8, then passes over bottom weft yarn 11, then passes under bottom weft yarns 14, 17, 20, 23, 26, 29 and 32, then passes over bottom weft yarn 35, then passes under bottom weft yarn 38, then passes over bottom weft yarn 41, then passes under bottom weft yarn 44. The bottom warp yarn 16 weaves only in the bottom layer, weaves first with one bottom weft yarn, e.g., bottom weft yarn 11, and then weaves with three bottom weft yarns, e.g., bottom weft yarns 35, 38 and 41. The pattern formed by bottom warp yarn 16 is the same as that of bottom warp yarn 14 except that it is shifted sideways by three bottom weft yarns.

Also seen in FIG. 6*b*, binding warp yarn 17 passes from the top layer to the bottom layer by passing under top weft yarns 1 and 3, then under bottom weft yarn 5, then passes from the bottom layer to the top layer by passing under top weft yarns 6 and 7, then weaves with the top weft yarns 9, 10, 12, 13 and 15 to form a plain weave, then passes from the top layer to the bottom layer by passing under top weft yarns 16 and 18, then passes over bottom weft yarn 20, then passes from the bottom layer to the top layer by passing under top weft yarns 21, 22, 24, 25, 27, 28 and 30, then weaves with the top weft yarns 31, 33, 34, 36 and 37 to form a plain weave, then passes from the top layer to the bottom layer by passing under top weft yarns 39, 40 and 42, then passes over bottom weft yarn 44, then begins to pass back to the top layer from the bottom layer by passing under top weft yarn 45. The binding warp yarn 17 binds to the bottom layer by weaving with the same non-adjacent bottom weft yarns that the bottom warp yarn 18 weaves with, e.g., by passing over the three non-adjacent bottom weft yarns 5, 20 and 44. The pattern formed by binding warp yarn 17 is different from that of the binding warp yarns 11, 13, 15 and 19.

FIG. 6*b* also illustrates bottom warp yarn 18 passing under bottom weft yarn 2, then passes over bottom weft yarn 5, then passes under bottom weft yarns 8, 11, 14 and 17, then passes over bottom weft yarn 20, then passes under bottom weft yarns 23, 26, 29, 32, 35, 38 and 41, then passes over bottom weft yarn 44. The bottom warp yarn 18 weaves only in the bottom layer and only with non-adjacent bottom weft yarns, e.g., three non-adjacent bottom weft yarns 5, 20 and 44. The pattern formed by bottom warp yarn 18 is different from that of the bottom warp yarns 12, 14, 16 and 20.

Also shown in FIG. 6*b*, binding warp yarn 19 passes over the top weft yarn 1, then passes from the top layer to the bottom layer by passing under top weft yarns 3, 4 and 6, then passes over bottom weft yarn 8, then passes under bottom weft yarn 11, then passes over bottom weft yarn 14, then passes from the bottom layer to the top layer by passing under top weft yarns 15 and 16, then weaves with the top weft yarns 18, 19, 21, 22 and 24 to form a plain weave, then passes from the top layer to the bottom layer by passing under top weft yarns 25 and 27, then passes over bottom weft yarn 29, then passes from the bottom layer to the top layer by passing under top weft yarns 30, 31, 33, 34, 36, 37 and 39, then weaves with top weft yarns 40, 42, 43 and 45 to form a plain weave. The binding warp yarn 19 binds to the bottom layer by weaving with the same bottom weft yarns that the bottom warp yarn 20 weaves with, e.g., by passing over the three non-adjacent bottom weft yarns 8, 14 and 29. The pattern formed by binding warp yarn 19 is the same as that of binding warp yarn 11 except that it is shifted sideways by six top weft yarns.

Finally, as seen in FIG. 6*b*, bottom warp yarn 20 passes under bottom weft yarns 2 and 5, then passes over bottom weft yarn 8, then passes under bottom weft yarn 11, then passes over bottom weft yarn 14, then passes under bottom weft yarns 17, 20, 23 and 26, then passes over bottom weft yarn 29, then passes under bottom weft yarns 32, 35, 38, 41 and 44. The bottom warp yarn 20 weaves only in the bottom layer and only with non-adjacent bottom weft yarns, e.g., three bottom weft yarns 8, 14 and 29. The pattern formed by bottom warp yarn 20 is the same as that of bottom warp yarn 12 except that it is shifted sideways by three bottom weft yarns.

As is apparent from a comparison of FIG. 6*a* and 6*b*, the paths taken by the warp yarns 1-10 through the weft yarns 1-45 are respectively the same as paths taken by the warp yarns 11-20 through the weft yarns 1-45, i.e., warp yarn 1 has the same path through the weft yarns 1-45 as warp yarn 11, warp yarn 2 has the same path through the weft yarns 1-45 as warp yarn 12, etc,.

Figure 7:
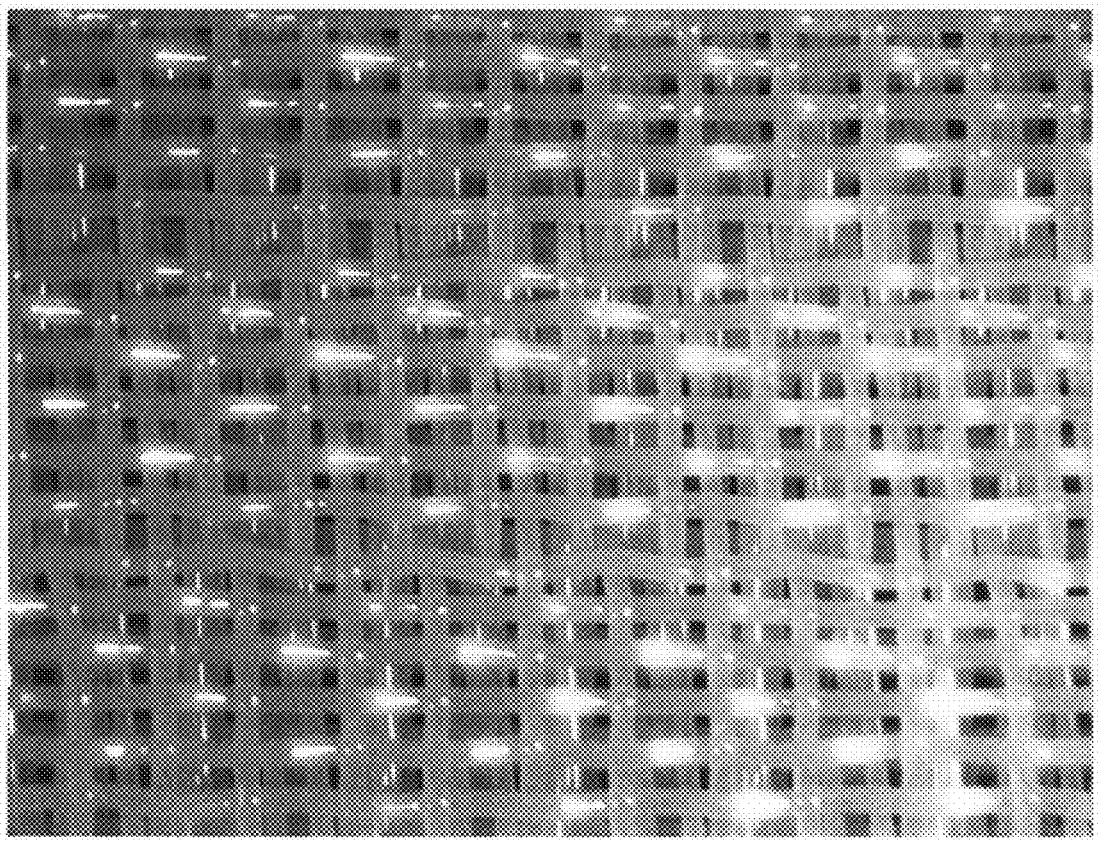
FIG. 7 shows a photograph of a top side or paper facing side of an actual forming fabric utilizing the weave pattern shown in FIGS. 5-6*b*.
Figure 8:
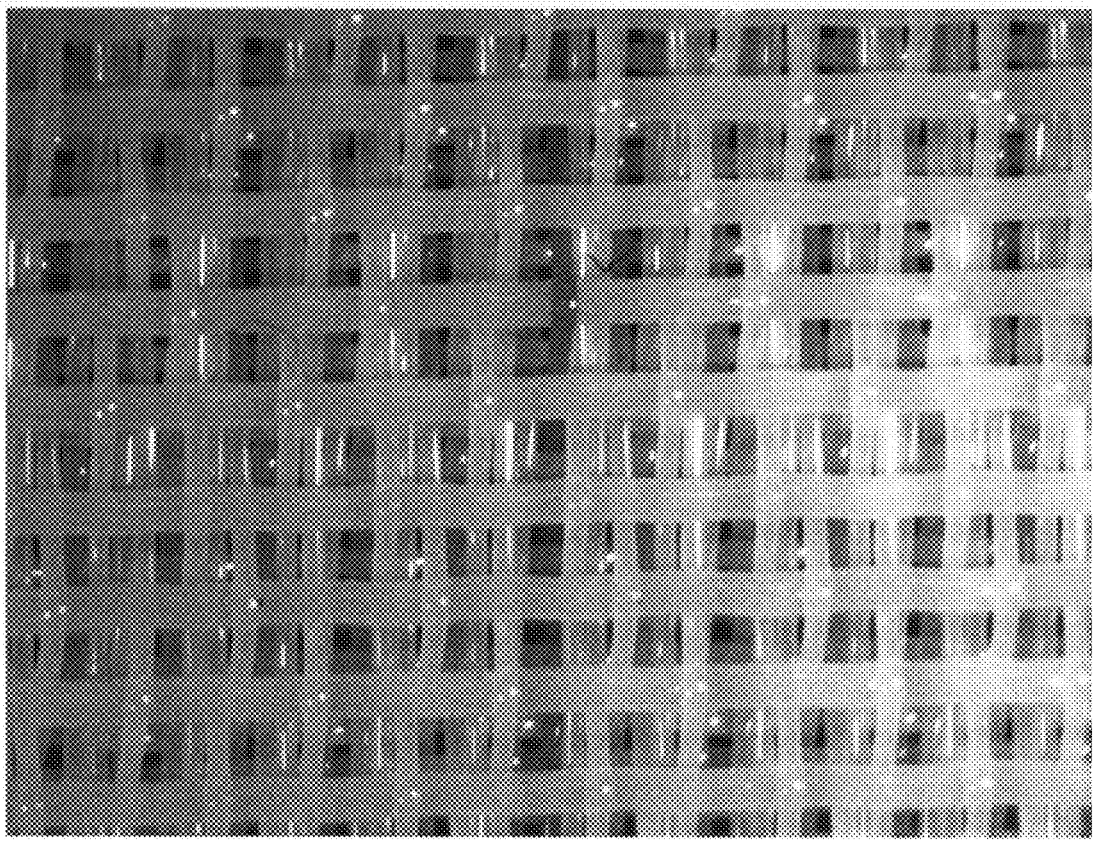
FIG. 8 shows a photograph of a bottom side or machine side of the forming fabric shown in FIG. 7.

FIG. 7 shows a photograph of a top side or paper facing side of an actual forming fabric utilizing the weave pattern shown in FIG. 5 and FIG. 8 shows a photograph of a bottom side or machine side of the forming fabric shown in FIG. 7.

By way of non-limiting example, the binding warp yarns 1, 3, 5, 7, 9, 11, 13, 15, 17 and 19 of the embodiment shown in FIGS. 5-6*b* can have the following characteristics: acceptable size range of between approximately 0.10 mm and approximately 0.50 mm, preferable size ranges of between approximately 0.20 mm and approximately 0.80 mm, and most preferred size range of between approximately 0.12 mm and approximately 0.20 mm. The material for these yarns can be any natural or synthetic material, preferably a synthetic monofilament, and most preferably a polyester monofilament.

By way of non-limiting example, the bottom warp yarns 2, 4, 6, 8, 10, 12, 14, 16, 18 and 20 of the embodiment shown in FIGS. 5-6*b* can have the following characteristics:,acceptable size range of between approximately 0.15 mm and approximately 0.60 mm, preferable size ranges of between approximately 0.20 mm and approximately 0.40 mm, and most preferred size range of between approximately 0.25 mm and approximately 0.35 mm. The material for these yarns can be any natural or synthetic material, preferably a synthetic monofilament, and most preferably a polyester monofilament. The bottom warp yarns can preferably be constructed using relatively large diameter yarns that are well suited to sustain the wear caused by the friction between the machine side surface of the fabric and the papermaking machine during use of the fabric.

By way of non-limiting example, the top weft yarns 1, 3, 4, 6, 7, 9, 10, 12, 13, 15, 16, 18, 19, 21, 22, 24, 25, 27, 28, 30, 31, 33, 34, 36, 37, 39, 40, 42, 43 and 45 of the embodiment shown in FIGS. 5-6*b* can have the following characteristics: acceptable size range of between approximately 0.10 mm and approximately 0.50 mm, preferable size ranges of between approximately 0.20 mm and approximately 0.80 mm, and most preferred size range of between approximately 0.12 mm and approximately 0.80 mm. The material for these yarns can be any natural or synthetic material, preferably a synthetic monofilament, and most preferably a polyester monofilament.

By way of non-limiting example, the bottom weft yarns 2, 5, 8, 11, 14, 17, 20, 23, 26, 29, 32, 35, 38, 41 and 44 of the embodiment shown in FIGS. 5-6*b* can have the following characteristics: acceptable size range of between approximately 0.15 mm and approximately 0.60 mm, preferable size ranges of between approximately 0.20 mm and approximately 0.40 mm, and most preferred size range of between approximately 0.25 mm and approximately 0.35 mm. The material for these yarns can be any natural or synthetic material, preferably a synthetic monofilament, and most preferably a polyester monofilament. These bottom weft yarns may also be constructed using larger diameter yarns than the upper warp yarns.

In the embodiment shown in FIGS. 5-6*b* all of the binding warp yarns form a plain weave in the top layer by weaving with five top weft yarns and bind to the bottom layer by weaving With at least one bottom weft yarns in two or more spaced apart locations. Furthermore, all of the bottom warp yarns weave only in the bottom layer. Additionally, when a binding warp yarn passes from the bottom layer to the top layer, it passes under at least two adjacent top weft yarns before weaving with a plain weave in the top layer. When a binding warp yarn passes from the top layer to the bottom layer, it passes under at least two adjacent top weft yarns before weaving with the bottom layer. The area of the plain weave (between a binding warp yarn and top weft yarns) is off-center with respect to an area or spacing between the two areas where the same binding warp yarn weaves to the bottom layer. Also, in the area or spacing between two the plain weave areas (between a binding warp yarn and top weft yarns), the area where the binding warp weaves with the bottom layer is off-center. These features are also desirable in numerous papermaking applications.

The invention encompasses a variety of different types of fabrics. For instance, the invention noted herein encompasses fabrics woven with different repeat than that pictured and described above. The fabric can have various top to bottom warp yarn ratios. The invention further contemplates other multilayer fabrics and not just the multilayer fabrics depicted in the figures.

The fabrics pictured and otherwise described and claimed herein may be employed in a variety, of applications, including board and packaging grades.

The configurations of the individual yarns utilized in the fabrics of the present invention can vary, depending upon the desired properties of the final papermakers' fabric. For example, the yarns may be multifilament yarns, monofilament yarns, twisted multifilament or monofilament yarns, spun yarns, or any combination thereof. Also, the materials comprising yarns employed in the fabric of the present invention may be those commonly used in papermakers' fabric. For example, the yarns may be formed of polypropylene, polyester, nylon, or the like. The skilled artisan should select a yarn material according to the particular application of the final fabric. Those of skill in the art will appreciate that yarns having diameters outside the herein disclosed ranges may be used in certain applications. In one embodiment of the present invention, one or more of the weft and warp yarns can have a diameter of about 0.13 mm, or about 0.17 mm, or about 0.33, or about 0.36 mm. Fabrics employing these yarn sizes may be implemented with polyester yarns or with a combination of polyester and nylon yarns.

The fabrics of the present invention have been described herein are flat woven fabrics and hence the warp yarns for these fabrics run in the machine direction (a direction aligned with the direction of travel of the papermakers' fabric on the papermaking machine) when the fabric is used on a papermaking machine and the weft yarns for these fabrics run in the cross machine direction (a direction parallel to the fabric surface and traverse to the direction of travel) when the fabric is used on a papermaking machine. However, those of skill in the art will appreciate that the fabrics of the present invention could also be woven using an endless weaving process. If such endless weaving were used, the warp yarns would run in the cross machine direction and the weft yarns would run in the machine direction when the fabric was used on a papermaking machine.

Pursuant to another aspect of the present invention, methods of making the papermaker's fabrics are provided. Pursuant to these methods, the fabrics can be woven using separate warp and weft beams.

Pursuant to another aspect of the present invention, methods of making paper are provided. Pursuant to these methods, one of the exemplary papermaker's forming fabrics described herein is provided, and paper is then made by applying paper stock to the forming fabric and by then removing moisture from the paper stock. As the details of how the paper stock is applied to the forming fabric and how moisture is removed from the paperstock is well understood by those of skill in the art, additional details regarding this aspect of the present invention will not be provided herein.

To the extent that the pattern repeat symbols shown in FIGS. 1 and 5 are inconsistent with the respective weave patterns shown in FIGS. 2*a*-2*b* and 6*a*-6*b*, the paths shown in FIGS. 2*a*-2*b* and 6*a*-6*b* shall serve as a basis for correcting the symbols shown in FIGS. 1 and 5. Applicant also reserves the right to submit any additional drawings showing weave patterns of the type shown in FIGS. 2*a*-2*b* and 6*a*-6*b* for any pattern repeat shown in FIGS. 1 and 5 which are not deemed to be consistent with the weave patterns shown in FIGS. 2*a*-2*b* and 6*a*-6*b*.

It is noted that the: foregoing examples have been provided merely for the purpose of explanation and are in no way to be construed as limiting of the present invention. While,the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A forming fabric comprising:

a top layer comprising top weft yarns;

a bottom layer comprising bottom weft yarns, binding warp yarns weaving with the top weft yarns and binding to the bottom layer;

at least one of the binding warp yarns passing between at least one top and bottom weft yarns before passing over at least one bottom weft yarn; and at least one bottom warp yarn weaving only in the bottom layer, wherein the at least one binding warp yarn and the at least one bottom warp yarn are vertically stacked.

2. The fabric of claim 1, further comprising at least one of:

all bottom warp yarns in a pattern repeat weaving with non-adjacent bottom weft yarns; and all bottom warp yarns in a pattern repeat weaving only in the bottom layer.

3. The fabric of claim 1, wherein at least one of:

the at least one binding warp yarn passing under at least two adjacent top weft yarns before passing over at least one bottom weft yarn; and each binding warp yarn binding to bottom layer by binding to non-adjacent bottom weft yarns.

4. The fabric of claim 1, wherein the at least one binding warp yarn comprises plural binding warp yarns that weave with the top weft yarns and bind to different non-adjacent bottom weft yarns per pattern repeat.

5. The fabric of claim 1, wherein the at least one binding warp yarn comprises plural binding warp yarns and each binding warp yarn binds to at least three non-adjacent bottom weft yarns per pattern repeat.

6. The fabric of claim 1, wherein the at least one binding warp yarn comprises plural binding yarns and, after weaving with the top weft yarns, each binding warp yarn binds to at least two non-adjacent bottom weft yarns per pattern repeat before again weaving with the top weft yarns.

7. The fabric of claim 1, wherein the at least one binding warp yarn comprises plural binding warp yarns and each of the binding warp yarns bind to at least four non-adjacent bottom weft yarns per pattern repeat.

8. The fabric of claim 1, wherein, after weaving with the top weft yarns and forming three knuckles, the at least one binding warp yarn passes under at least two adjacent top weft yarns before binding with the bottom weft yarns.

9. The fabric of claim 1, wherein, after weaving with the top weft yarns, the at least one binding warp yarn passes under at least two adjacent top weft yarns before binding to two non-adjacent bottom weft yarns.

10. The fabric of claim 1, wherein, after weaving with the top weft yarns, the at least one binding warp yarn passes under at least three adjacent top weft yarns before binding with the bottom weft yarns.

11. The fabric of claim 1, wherein, after weaving with the top weft yarns, the at least one binding warp yarn passes under at least three adjacent top weft yarns before binding to two non-adjacent bottom weft yarns.

12. The fabric of claim 1, wherein the top layer and bottom layer are bound together only by plural of the at least one the binding warp yarns and the binding warp yarns are intrinsic warp yarns.

13. The fabric of claim 1, wherein the at least one binding warp yarn comprises plural binding warp yarns and each binding warp yarn in a pattern repeat weaves with a plain weave with top weft yarns before binding with non-adjacent bottom weft yarns.

14. The fabric of claim 13, wherein each binding warp yarn in the pattern repeat weaves with a plain weave with top weft yarns before binding with two non-adjacent bottom weft yarns.

15. The fabric of claim 13, wherein, in the pattern repeat, each binding warp yarn weaves with a plain weave with top weft yarns, then binds with two non-adjacent bottom weft yarns, and then weaves with a plain weave with top weft yarns.

16. The fabric of claim 1, wherein, in a pattern repeat, the at least one binging warp yarn binds with first and second non-adjacent bottom weft yarns and the at least one bottom warp yarn weaves with the first and second bottom weft yarns.

17. The fabric of claim 1, wherein, in a pattern repeat, the at least one binding warp yarn binds with first, second and third non-adjacent bottom weft yarns and the at least one bottom warp yarn weaves with the first, second and third bottom weft yarns.

18. The fabric of claim 1, wherein, in a pattern repeat, the at least one binding warp yarn binds with only first, second and third non-adjacent bottom weft yarns and the at least one bottom warp yarn weaves with the first, second and third bottom weft yarns.

19. The fabric of claim 1, wherein, in a pattern repeat, each binding warp yarns binds with only first, second and third non-adjacent bottom weft yarns and vertically stacked bottom warp yarns weave only with a same first, second and third bottom weft yarns.

20. The fabric of claim 1, wherein, in a pattern repeat, the at least one binding warp yarn binds with first, second, third and fourth non-adjacent bottom weft yarns and the at least one bottom warp yarn weaves with the first, second, third and fourth bottom weft yarns.

21. The fabric of claim 1, wherein, in a pattern repeat, the at least one binding warp yarn binds with only first, second, third and fourth non-adjacent bottom weft yarns and the at least one bottom warp yarns weave with the first, second, third and fourth bottom weft yarns.

22. The fabric of claim 1, wherein, in a pattern repeat, the at least one binding warp yarn comprises plural binding warp yarns and each binding warp yarns binds with only first, second, third and fourth non-adjacent bottom weft yarns and vertically stacked bottom warp yarns weave only with the first, second, third and fourth bottom weft yarns.

23. The fabric of claim 1, wherein the at least one bottom warp yarn comprises plural bottom warp yarns and, in a pattern repeat, all bottom warp yarns weave only in the bottom layer to non-adjacent bottom weft yarns.

24. The fabric of claim 1, wherein the at least one binding warp yarn comprises plural binding warp yarns and all of the binding warp yarns weave only with a plain weave when in the top layer.

25. The fabric of claim 24, wherein the at least one binding warp yarn comprises plural binding warp yarns and all of the binding warp yarns bind to non-adjacent bottom weft yarns in a pattern repeat.

26. The fabric of claim 24, wherein the at least one binding warp yarn comprises plural binding warp yarns and the binding warp yarns bind to different non-adjacent bottom weft yarns in a pattern repeat.

27. The fabric of claim 1, wherein the top layer has a papermaking surface and the bottom has a machine side surface.

28. The fabric of claim 1, wherein the at least one binding warp yarn comprises plural binding warp yarns and, in a pattern repeat, each of the binding warp yarns binds to only one of three non-adjacent bottom weft yarns in the bottom layer; and four non-adjacent bottom weft yarns in the bottom layer.

29. The fabric of claim 1, wherein, in a pattern repeat, more top weft yarns are utilized that bottom weft yarns.

30. The fabric of claim 1, wherein, in a pattern repeat, 30 top weft yarns are utilized and 20 bottom weft yarns are utilized.

31. The fabric of claim 1, wherein, in a pattern repeat, 30 top weft yarns are utilized and 15 bottom weft yarns are utilized.

32. The fabric of claim 1, wherein, in a pattern repeat, 20 binding warp yarns are utilized and 20 bottom warp yarns are utilized.

33. The fabric of claim 1, wherein the at least one binding warp yarn comprises plural binding warp yarns and at least one of the binding warp yarns per pattern repeat differ from bottom warp yarns in at least one of the following characteristics:

size;

modulus; and material.

34. The fabric of claim 1, wherein at least one of the top weft yarns per pattern repeat differ from the bottom weft yarns in at least one of the following characteristics:

size;

modulus; and material.

35. The fabric of claim 1, wherein the at least one binding warp yarn comprises plural binding warp yarns and at least one of the binding warp yarns is smaller in size than the at least one bottom warp yarn.

36. The fabric of claim 1, wherein at least one of:

the top layer has a different weave pattern than the bottom layer; and the top layer utilizes a plain weave and the bottom layer does not utilize a plain weave.

37. A forming fabric comprising:

a top layer comprising top weft yarns;

a bottom layer comprising bottom weft yarns;

at least one binding warp yarn weaving with the top weft yarns and binding to at least two non-adjacent bottom weft yarns in a pattern repeat; and at least one bottom warp yarn weaving only in the bottom layer, wherein the at least one binding warp yarn and the at least one bottom warp yarn are vertically stacked.

38. A forming fabric comprising:

a top layer comprising top weft yarns;

a bottom layer comprising bottom weft yarns;

at least one binding warp yarn weaving with top weft yarns and binding to at least two non-adjacent bottom weft yarns in a pattern repeat; and at least one bottom warp yarn not weaving with the top weft yarns in a pattern repeat and weaving with the at least two non-adjacent bottom weft yarns and passing between multiple adjacent top and bottom weft yarns.

39. A method of making the fabric of claim 1, wherein the at least one binding warp yarn comprises plural binding warp yarns, the method comprising:

binding together the top and bottom layers using only the plural binding warp yarns.

40. A method of making the fabric of claim 1, wherein the at least one binding warp yarn comprises plural binding warp yarns, the method comprising:

binding the top and bottom layers together using the plural binding warp yarns, wherein each binding warp yarn binds to at least three non-adjacent bottom weft yarns per pattern repeat.

41. A forming fabric comprising:

a top layer comprising top weft yarns;

a bottom layer comprising bottom weft yarns, binding warp yarns weaving with the top weft yarns and binding to the bottom layer; and at least one of the binding warp yarns passing between at least one top and bottom weft yarns before passing over at least one bottom weft yarn, wherein, in a pattern repeat, the at least one binding warp yarn weaves with a plain weave that forms three knuckles in the top layer, then passes under plural top weft yarns, then binds to the bottom layer, then passes under plural top weft yarns, and then weaves with a plain weave that forms three knuckles in the top layer.

42. The fabric of claim 41, further comprising:

at least one bottom warp yarn weaving only in the bottom layer, wherein the at least one binding warp yarn and the at least one bottom warp yarn are vertically stacked.

* * * * *